US006616270B1

(12) United States Patent
Miyata et al.

(10) Patent No.: US 6,616,270 B1
(45) Date of Patent: Sep. 9, 2003

(54) INK JET RECORDING HEAD AND INK JET RECORDING APPARATUS COMPRISING THE SAME

(75) Inventors: Yoshinao Miyata, Nagano (JP); Shinri Sakai, Nagano (JP); Yutaka Furuhata, Nagano (JP); Tsutomu Hashizume, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/696,010

(22) Filed: Oct. 26, 2000

Related U.S. Application Data

(63) Continuation-in-part of application No. 09/376,350, filed on Aug. 18, 1999, now abandoned.

(30) Foreign Application Priority Data

| | | |
|---|---|---|
| Aug. 21, 1998 | (JP) | 10-235249 |
| Aug. 26, 1998 | (JP) | 10-2398525 |
| Oct. 21, 1998 | (JP) | 10-299779 |
| Feb. 12, 1999 | (JP) | 11-034592 |
| Aug. 5, 1999 | (JP) | 11-222062 |
| Mar. 24, 2000 | (JP) | 2000-083799 |

(51) Int. Cl.[7] ..... B41J 2/045
(52) U.S. Cl. ..... 347/68
(58) Field of Search ..... 347/68, 70, 71, 347/69, 54, 86, 47, 20; 29/25.35; 310/342, 311; 400/124.16, 124.11

(56) References Cited

U.S. PATENT DOCUMENTS

| | | | | |
|---|---|---|---|---|
| 5,265,315 A | * | 11/1993 | Hoisington et al. | 29/25.35 |
| 5,652,609 A | * | 7/1997 | Scholler et al. | 347/54 |
| 5,784,085 A | * | 7/1998 | Hosono et al. | 347/70 |
| 6,231,169 B1 | * | 5/2001 | Yazaki et al. | 347/70 |
| 6,286,945 B1 | * | 9/2001 | Higuma et al. | 347/86 |

FOREIGN PATENT DOCUMENTS

| | | | |
|---|---|---|---|
| EP | 0 677 386 A2 | 10/1995 | B41J/2/045 |
| EP | 0 707 961 A2 | 4/1996 | B41J/2/045 |
| EP | 0 738 599 A2 | 10/1996 | B41J/2/045 |
| JP | 63-37958 A | 2/1988 | |
| JP | 63-149159 A | 6/1988 | |
| JP | 03-243357 A | 2/1990 | |
| JP | 3-187756 A | 8/1991 | |
| JP | 6-40035 A | 2/1994 | |
| JP | 6-255101 A | 9/1994 | |
| JP | 7-156396 A | 6/1995 | |
| JP | 8-20107 A | 1/1996 | |
| JP | 8-169111 A | 7/1996 | |
| JP | 9-123449 A | 5/1997 | |
| JP | 9-226115 A | 9/1997 | |
| JP | 9-227516 A | 10/1997 | |
| JP | 9-314863 A | 12/1997 | |
| JP | 10-128976 A | 5/1998 | |
| JP | 10-166572 A | 6/1998 | |

* cited by examiner

*Primary Examiner*—Lamson Nguyen
*Assistant Examiner*—K. Feggins
(74) *Attorney, Agent, or Firm*—Sughrue Mion, PLLC

(57) ABSTRACT

An ink jet recording head comprises a nozzle forming member provided with a plurality of nozzle orifices for jetting ink, a channel forming substrate provided with a plurality of pressure generating chambers communicated with the associated nozzle orifices, one face of which is bonded to the nozzle forming member, a plurality of piezoelectric elements provided on an face of the channel forming substrate which is opposed to the face bonded to the nozzle forming substrate for causing pressure change to occur in the associated pressure generating chambers, and a reservoir forming member bonded to the face of the channel forming substrate on which the piezoelectric elements are provided, the reservoir forming member having a reservoir section forming at least a part of a reservoir communicated with the pressure generating chambers for supplying ink thereto and a piezoelectric element holding section for defining a space in an area facing the piezoelectric elements such an extent that motion of the respective piezoelectric elements is exhibited while sealing the space hermetically.

52 Claims, 23 Drawing Sheets

INK JET RECORDING HEAD AND INK JET RECORDING APPARATUS COMPRISING THE SAME

CROSS-REFERENCE TO RELATED APPLICATION

This is a continuation-in-part application of U.S. patent application Ser. No. 09/376,350 filed on Aug. 18, 1999 now abandoned.

BACKGROUND OF THE INVENTION

This invention relates to an ink jet recording head wherein a piezoelectric element is formed via a diaphragm in a part of each of pressure generating chambers communicating with nozzle orifices for jetting ink drops and ink drops are jetted by displacement of the piezoelectric element, and an ink jet recording apparatus comprising the ink jet recording head.

The following two types of ink jet recording heads, each wherein a part of a pressure generating chamber communicating with a nozzle orifice for jetting an ink drop is formed of a diaphragm and the diaphragm is deformed by a piezoelectric element for pressurizing ink in the pressure generating chamber for jetting an ink drop through the nozzle orifice, are commercially practical: One uses a piezoelectric actuator in a vertical vibration mode in which the piezoelectric element is expanded and contracted axially and the other uses a piezoelectric actuator in a deflection vibration mode.

With the former, the volume of the pressure generating chamber can be changed by abutting an end face of the piezoelectric element against the diaphragm and a head appropriate for high-density printing can be manufactured, but a difficult step of dividing the piezoelectric element like comb teeth matching the arrangement pitch of the nozzle orifices and work of positioning and fixing the piezoelectric element divisions in the pressure generating chambers are required and the manufacturing process is complicated.

In contrast, with the latter, the piezoelectric element can be created and attached to the diaphragm by executing a comparatively simple process of putting a green sheet of a piezoelectric material matching the form of the pressure generating chamber and baking it, but a reasonable area is required because deflection vibration is used; high-density arrangement is difficult to make.

On the other hand, to solve the problem of the latter recording head, Japanese Patent Publication No. 5-286131A proposes an art wherein an uniform piezoelectric material layer is formed over the entire surface of a diaphragm according to a film formation technique and is divided to a form corresponding to a pressure generating chamber according to a lithography technique for forming a piezoelectric element separately for each pressure generating chamber.

This eliminates the need for work of putting the piezoelectric element on the diaphragm and the piezoelectric element can be created by the lithography method, an accurate and simple technique. In addition, the piezoelectric element can be thinned and high-speed drive is enabled. In this case, with the piezoelectric material layer provided on the whole surface of the diaphragm, at least only upper electrodes are provided in a one-to-one correspondence with the pressure generating chambers, whereby the piezoelectric actuator corresponding to each pressure generating chamber can be driven.

In such an ink jet recording head, generally a reservoir which becomes an ink chamber common to pressure generating chambers is formed by depositing a plurality of substrates on each other, and ink is supplied from the reservoir to the pressure generating chambers. To hold the internal pressure of the reservoir constant, the reservoir is provided with a compliance section for absorbing pressure change when a piezoelectric element is driven.

However, a large number of substrates used to form the reservoir are required; particularly a large number of substrates deposited to form the compliance section are required, increasing material and assembly costs.

The ink jet recording head as described above is intended to have a large number of nozzles and it is necessary to form the reservoir in size capable of sufficiently supplying ink to the pressure generating chambers accordingly; the strength of the substrates forming the reservoir is degraded inevitably. Thus, if heat is applied to the substrates at an installation step, the substrates are warped due to thermal expansion and a crack occurs.

To use silicon for the substrate for defining each pressure generating chamber, it is difficult to bond at a high temperature because of the difference from other substrates in thermal expansion coefficient and the number of assembly steps is increased.

SUMMARY OF THE INVENTION

It is therefore an object of the invention to provide an ink jet recording head for preventing deformation and cracking of substrates with a structure simplified and manufacturing costs reduced, and an ink jet recording apparatus comprising the ink jet recording head.

In order to achieve the above object, according to a first aspect of the invention, there is provided an ink jet recording head comprising: a nozzle forming member provided with a plurality of nozzle orifices for jetting ink; a channel forming substrate provided with a plurality of pressure generating chambers communicated with the associated nozzle orifices, one face of which is bonded to the nozzle forming member; a plurality of piezoelectric elements provided on an face of the channel forming substrate which is opposed to the face bonded to the nozzle forming substrate with a vibration plate in between for changing the associated pressure generating chambers in volume thereof; and a reservoir forming member bonded to the face of the channel forming substrate on which the piezoelectric elements are provided, the reservoir forming member having a reservoir section forming at least a part of a reservoir communicated with the pressure generating chambers for supplying ink thereto, and a piezoelectric element holding section for defining a space in an area facing the piezoelectric elements such an extent that motion of the respective piezoelectric elements is exhibited while sealing the space hermetically.

In the first aspect, the number of substrates deposited for forming the reservoir can be reduced and the structure can be simplified. In addition, the piezoelectric elements are hermetically sealed in the piezoelectric element holding section and destruction of the piezoelectric elements caused by the external environment is prevented.

According to a second aspect of the invention, in the ink jet recording head in the first aspect, the piezoelectric element holding section is partitioned by partition walls so as to correspond to the respective piezoelectric elements and the partition walls are bonded to the channel forming substrate.

In the second aspect, the rigidity of the peripheral walls partitioning the pressure generating chambers is increased, and falling down of the peripheral walls when the piezoelectric element is driven is prevented.

According to a third aspect of the invention, in the ink jet recording head in the first or second aspect, the channel forming substrate is formed with a communication section for communicating with the reservoir section of the reservoir forming member to form a part of the reservoir together with the reservoir section.

In the third aspect, the reservoir is made up of the reservoir section and the communication section; a reservoir of a relatively large volume can be formed easily.

According to a fourth aspect of the invention, in the ink jet recording head in any of the first to third aspects, the reservoir and each pressure generating chamber are made to communicate with each other via an ink supply passage relatively narrower than the reservoir.

In the fourth aspect, ink is supplied from the reservoir to the pressure generating chamber via the ink supply port having a relatively narrower flow passage than the reservoir, so that the amount of bubbles mixed into the ink is suppressed.

According to a fifth aspect of the invention, in the ink jet recording head in any of the first to fourth aspects, an ink introduction port communicating with the outside for supplying ink to the reservoir is made to communicate with the reservoir section.

In the fifth aspect, ink is supplied through the ink introduction port to the reservoir.

According to a sixth aspect of the invention, in the ink jet recording head in any of the first to fifth aspects, the reservoir section is so formed as to be across the pressure generating chambers placed side by side.

In the sixth aspect, ink is supplied from the reservoir common to the pressure generating chambers.

According to a seventh aspect of the invention, in the ink jet recording head in any of the first to sixth aspects, a part of the reservoir section of the reservoir forming member has a flexible section having flexibility.

In the seventh aspect, change in the internal pressure of the reservoir is absorbed as the flexible section becomes deformed, whereby the inside of the reservoir is always held at a constant pressure.

According to an eighth aspect of the invention, in the ink jet recording head in the seventh aspect, the channel forming substrate in the area corresponding to the reservoir section is formed with a through section piercing the channel forming substrate without communicating with the pressure generating chambers. The flexible portion is defined as a section between the through section and the reservoir section.

In the eighth aspect, the flexible section placed between the through section and the reservoir section becomes elastically deformed, thereby absorbing pressure change in the reservoir for always holding the inside of the reservoir at a constant pressure.

According to a ninth aspect of the invention, in the ink jet recording head in the eighth aspect, the through section is so formed as to be across the pressure generating chambers placed side by side.

In the ninth aspect, the flexible section is formed in an area capable of sufficiently absorbing pressure change in the reservoir.

According to a tenth aspect of the invention, in the ink jet recording head in the eighth or ninth aspect, the through section is etched together with the pressure generating chambers and is formed.

In the tenth aspect, the flexible section can be formed relatively easily.

According to an eleventh aspect of the invention, in the ink jet recording head in any of the seventh to tenth aspects, the flexible section is provided by bonding a flexible member.

In the eleventh aspect, the flexible section can be easily provided by bonding a flexible member.

According to a twelfth aspect of the invention, in the ink jet recording head in the eleventh aspect, the flexible member is a thin film made of at least one of metal and ceramic.

In the twelfth aspect, a thin film is formed, whereby the flexible section can be easily formed.

According to a thirteenth aspect of the invention, in the ink jet recording head in the eleventh aspect, the flexible member is made of a resin material.

In the thirteenth aspect, the flexible section is made of a resin member and thus can be easily formed.

According to a fourteenth aspect of the invention, in the ink jet recording head in the thirteenth aspect, the resin material is at least one selected from the group consisting of fluororesin, silicone resin, and silicone rubber.

In the fourteenth aspect, a specific resin material is used, whereby the flexible section can be formed reliably.

According to a fifteenth aspect of the invention, in the ink jet recording head in the eleventh aspect, the flexible member contains a layer having a tensile stress.

In the fifteenth aspect, the flexible film is not buckled and can be prevented from being destroyed.

According to a sixteenth aspect of the invention, in the ink jet recording head in the eleventh aspect, the flexible member is composed of a layer forming the piezoelectric elements.

In the sixteenth aspect, when the piezoelectric elements are formed, the flexible member can be easily formed together with the piezoelectric elements.

According to a seventeenth aspect of the invention, in the ink jet recording head in any of the eleventh to sixteenth aspects, another substrate having a through hole at least in an area facing the flexible section is bonded to the flexible member.

In the seventeenth aspect, the strength of other portions than the flexible section is enhanced and the durability of the head is improved.

According to an eighteenth aspect of the invention, in the ink jet recording head in any of the eleventh to seventeenth aspects, a projected beam member is provided on the surface of the flexible member on the opposite side to the reservoir section so as to extend in a plane direction of the flexible member.

In the eighteenth aspect, the strength of the flexible film is increased by means of the beam member and the durability is improved.

According to a nineteenth aspect of the invention, in the ink jet recording head in the eighteenth aspect, the beam member is formed like a grid.

In the nineteenth aspect, the strength of the flexible film is increased by means of the grid-like beam member and the durability is improved.

According to a twentieth aspect of the invention, in the ink jet recording head in any of the first to nineteenth aspects, the reservoir section is provided with at least one beam-like reinforcing member across side walls defining the reservoir section and facing each other.

In the twentieth aspect, the rigidity of the reservoir section is enhanced by means of the reinforcing section and cracking of the reservoir forming member caused by a thermal stress at the installation time is prevented.

According to a twenty-first aspect of the invention, in the ink jet recording head in the twentieth aspect, at least a part of the reinforcing section is thinner than any other portion of the reservoir forming member.

In the twenty-first aspect, the rigidity of the reservoir section is improved without degrading the function of the reservoir.

According to a twenty-second aspect of the invention, in the ink jet recording head in the twenty-first aspect, at least a part of the reinforcing section on the side of the channel forming substrate is removed and is thinner than any other portion.

In the twenty-second aspect, the function of the reservoir can be maintained reliably and the rigidity of the reservoir section is -improved.

According to a twenty-third aspect of the invention, in the ink jet recording head in any of the twentieth to twenty-second aspects, the reinforcing section is formed along the longitudinal direction of the piezoelectric elements.

In the twenty-third aspect, cracking of the reservoir forming substrate caused by a thermal stress at the installation time is prevented reliably.

According to a twenty-fourth aspect of the invention, in the ink jet recording head in any of the first to twenty-third aspects, at least a part of the area of the reservoir forming member facing the piezoelectric element is formed with a detection through hole for detecting displacement of the piezoelectric element.

In the twenty-fourth aspect, displacement of the piezoelectric element can be detected easily from the outside of the reservoir forming member.

According to a twenty-fifth aspect of the invention, in the ink jet recording head in the twenty-fourth aspect, the piezoelectric element holding section is formed by piercing the reservoir forming member and is sealed with a transparent member, and also serves as the detection through hole.

In the twenty-fifth aspect, displacement of the piezoelectric element can be detected with the piezoelectric element hermetically sealed.

According to a twenty-sixth aspect of the invention, in the ink jet recording head in the twenty-fifth aspect, the transparent member forms the flexible section.

In the twenty-sixth aspect, change in the internal pressure of the piezoelectric element holding section is absorbed as the transparent member becomes deformed, whereby the internal pressure of the piezoelectric element holding section is held constant.

According to a twenty-seventh aspect of the invention, the ink jet recording head in any of the first to twenty-sixth aspects further comprises: a first wiring drawn out from the piezoelectric elements on the channel forming substrate; a second wiring provided on the reservoir forming member in an area opposite side of the channel forming substrate; a connection wiring for connecting the first and second wirings; and an external wiring connected to the second wiring.

In the twenty-seventh aspect, the wiring drawn out from the piezoelectric element and the external wiring are connected in the area of the reservoir forming member on the opposite side to the channel forming substrate, so that the head can be miniaturized.

According to a twenty-eighth aspect of the invention, in the ink jet recording head in the twenty-seventh aspect, the connection wiring is formed by wire bonding.

In the twenty-eighth aspect, the connection wiring can be formed easily.

According to a twenty-ninth aspect of the invention, in the ink jet recording head in the twenty-seventh aspect, the connection wiring is formed of a thin film.

In the twenty-ninth aspect, the connection wiring can be formed easily.

According to a thirtieth aspect of the invention, in the ink jet recording head in any of the twenty-seventh to twenty-ninth aspects, the reservoir forming member is formed with a communication hole piercing the reservoir forming member for communicating with the outside in the area corresponding to the piezoelectric element. The connection wiring is provided via the communication hole.

In the thirtieth aspect, the connection wiring can be placed in the reservoir forming member, so that the head can be miniaturized.

According to a thirty-first aspect of the invention, in the ink jet recording head in the thirtieth aspect, the communication hole is made in the area facing a peripheral wall of the pressure generating chamber on the reservoir side.

In the thirty-first aspect, the connection wiring is placed via the communication hole on the reservoir side.

According to a thirty-second aspect of the invention, in the ink jet recording head in the thirtieth aspect, the communication hole is made in the area facing a peripheral wall of the pressure generating chamber on the nozzle orifice side.

In the thirty-second aspect, the connection wiring is placed via the communication hole on the nozzle orifice side.

According to a thirty-third aspect of the invention, in the ink jet recording head in any of the twenty-seventh to thirty-second aspects, a drive circuit for driving the piezoelectric elements is mounted in the reservoir forming member. The connection wiring is connected to the drive circuit.

In the thirty-third aspect, the drive circuit can be mounted on the reservoir forming member for saving the space.

According to a thirty-fourth aspect of the invention, in the ink jet recording head in the thirty-third aspect, the drive circuit is a semiconductor integrated circuit.

In the thirty-fourth aspect, the drive circuit can be mounted easily on the reservoir forming member and space saving can be intended reliably.

According to a thirty-fifth aspect of the invention, in the ink jet recording head in any of the first to thirty-fourth aspects, the reservoir forming member is a reservoir forming substrate including the reservoir section.

In the thirty-fifth aspect, the ink jet recording head capable of reliably supplying ink to the pressure generating chambers through the reservoir can be realized easily.

According to a thirty-sixth aspect of the invention, in the ink jet recording head in the thirty-fifth aspect, the thermal expansion coefficient of the reservoir forming substrate is substantially the same as that of the channel forming substrate.

In the thirty-sixth aspect, it is made possible to bond the reservoir forming member and the channel forming substrate at a high temperature, and the manufacturing process can be simplified.

According to a thirty-seventh aspect of the invention, in the ink jet recording head in the thirty-fifth or thirty-sixth aspect, the reservoir forming substrate is made of at least one material selected from the group consisting of silicon, glass, and ceramics.

In the thirty-seventh aspect, the reservoir forming substrate is formed of a specific material, whereby the manufacturing process can be simplified reliably.

According to a thirty-eighth aspect of the invention, in the ink jet recording head in any of the first to thirty-seventh aspects, the nozzle forming member is formed of substantially the same material as the channel forming substrate and the reservoir forming member.

In the thirty-eighth aspect, joining of the nozzle forming member is facilitated and the manufacturing process can be simplified.

According to a thirty-ninth aspect of the invention, in the ink jet recording head in any of the first to thirty-eighth aspects, the nozzle forming member is a nozzle plate provided with the nozzle orifices.

In the thirty-ninth aspect, the ink jet recording head for jetting ink through the nozzle orifices can be realized easily.

According to a fortieth aspect of the invention, in the ink jet recording head in any of the first to thirty-ninth aspects, the pressure generating chambers are formed on a ceramic substrate. The layers of the piezoelectric element are formed by putting a green sheet or printing.

In the fortieth aspect, the head can be manufactured easily.

According to a forty-first aspect of the invention, in the ink jet recording head in any of the first to fortieth aspects, the pressure generating chambers are formed on a silicon monocrystalline substrate by anisotropic etching and the layers of the piezoelectric element are formed by thin film deposition and lithography method.

In the forty-first aspect, ink jet recording heads each having high-density nozzle orifices can be manufactured in large quantities and comparatively easily.

According to a forty-second aspect of the invention, there is provided an ink jet recording apparatus comprising an ink jet recording head in any of first to forty-first aspects.

In the forty-second aspect, an ink jet recording apparatus with the head structure simplified and manufacturing costs reduced can be realized.

DETAILED DESCRIPTION OF THE PREFERRED EMBODIMENTS

Referring now to the accompanying drawings, there are shown preferred embodiments of the invention.

Figure 1:
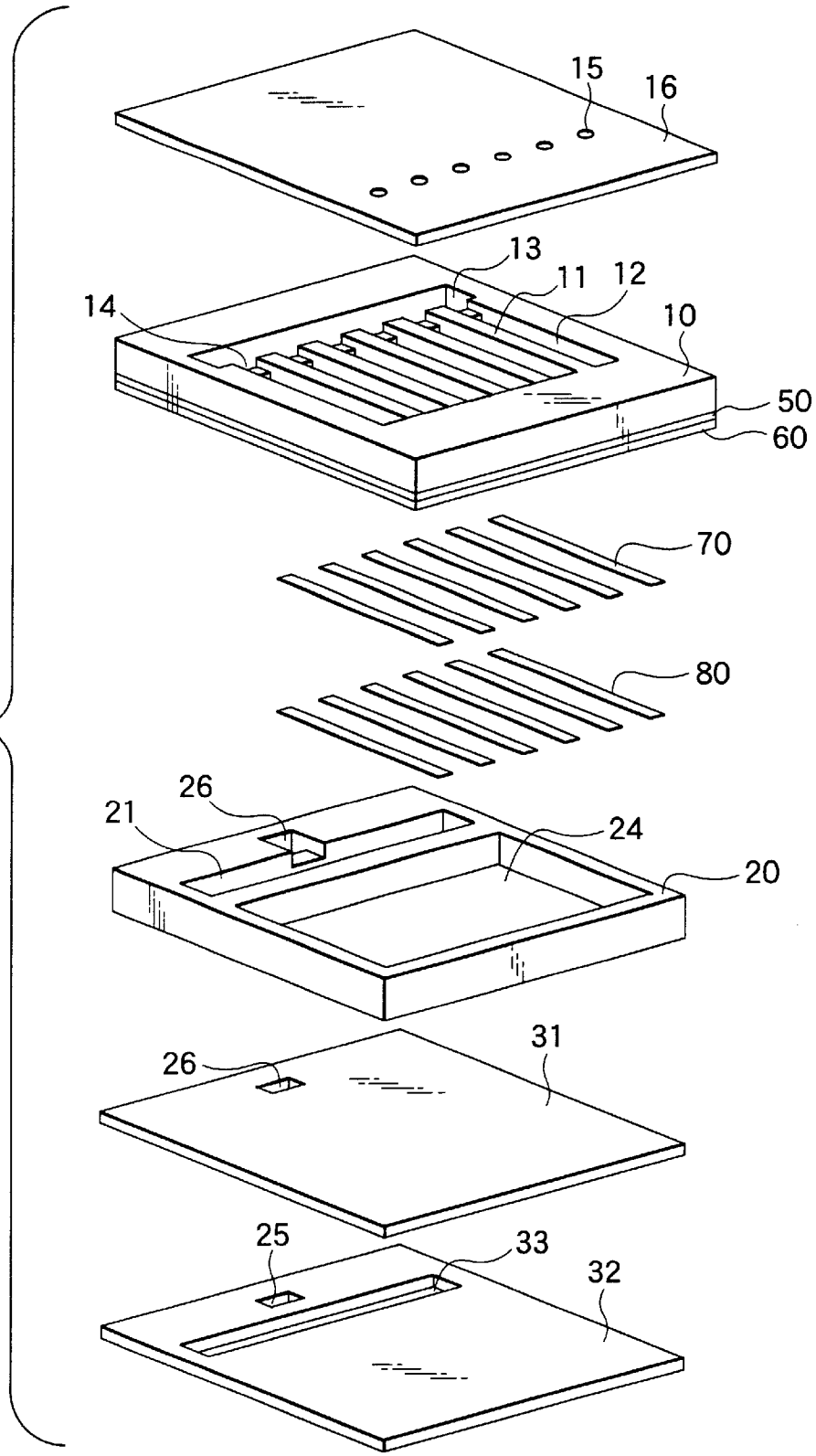
FIG. 1 is an exploded perspective view of an ink jet recording head according to a first embodiment of the invention.
Figure 2A:
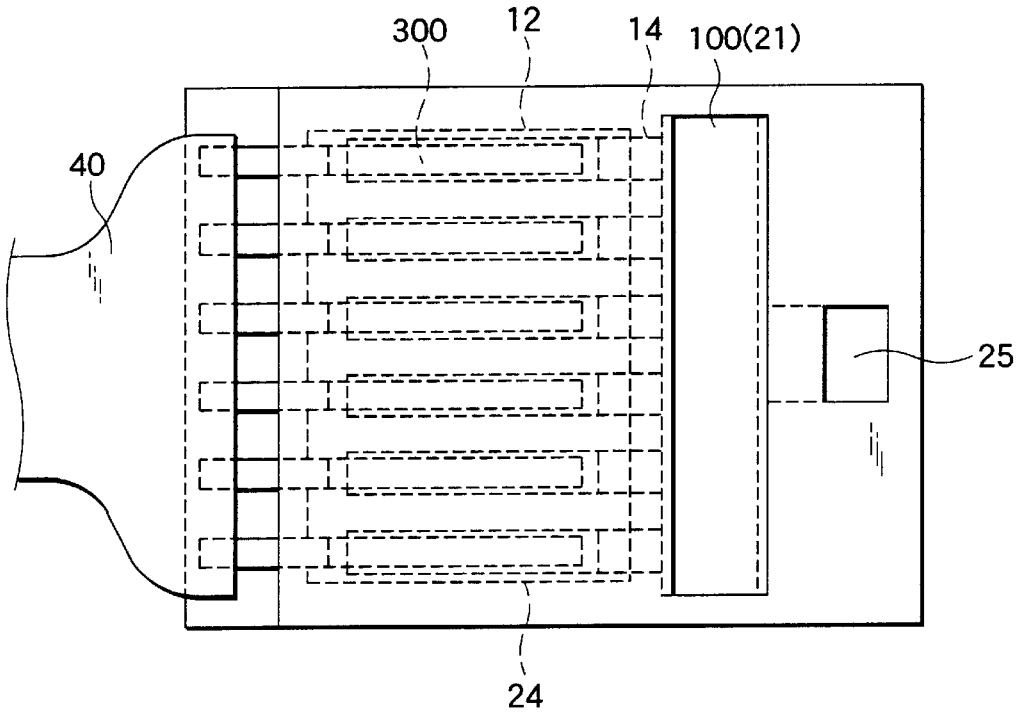
FIGS. 2A and 2B are a plan view and a sectional view of the ink jet recording head according to the first embodiment of the invention.
Figure 2B:
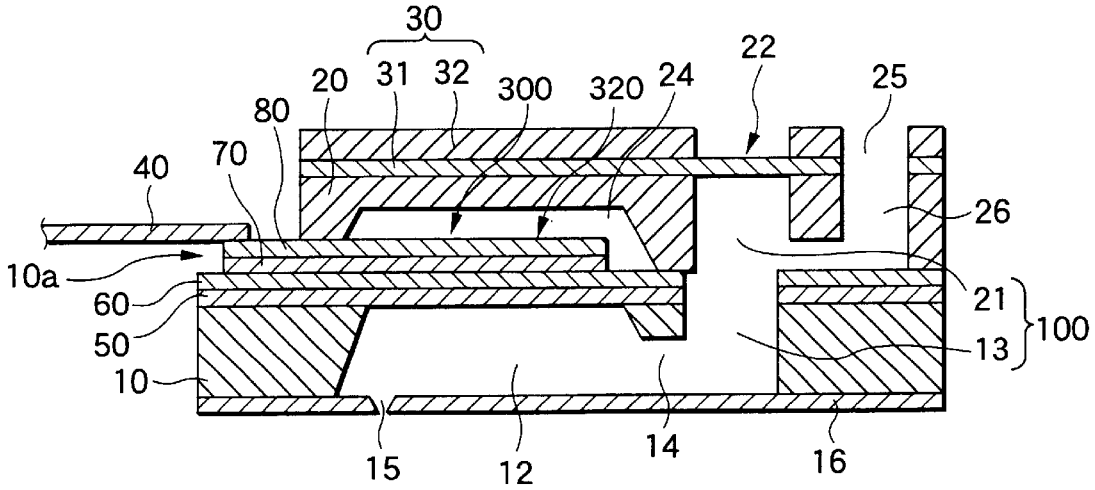

First Embodiment:

FIG. 1 is an exploded perspective view to show an ink jet recording head according to a first embodiment of the invention. FIGS. 2A and 2B are a plan view and a sectional view of the ink jet recording head shown in FIG. 1.

As shown in the figure, a channel forming substrate 10 is made of a silicon monocrystalline substrate of a <110> plane orientation in the embodiment. Normally, a substrate about 150–300 μm thick is used as the channel forming substrate 10; preferably a substrate about 180–280 μm thick, more preferably a substrate about 220 μm thick is used because the arrangement density can be made high while the rigidity of a partition between contiguous pressure generating chambers is maintained.

The channel forming substrate 10 is formed on one face with an opening face and on an opposite face with an elastic film 50 of 1–2 μm thick made of silicon dioxide previously formed by thermal oxidation.

On the other hand, the channel forming substrate 10 is formed on the opening face with pressure generating chambers 12 which are partitioned by a plurality of partitions 11 and are placed side by side in a width direction by anisotropically etching the silicon monocrystalline substrate and is formed on the outside in the longitudinal direction thereof with a communication section 13 communicating with a reservoir section of a reservoir forming substrate described later and forming a part of a reservoir 100 which becomes an ink chamber common to the pressure generating chambers 12; the communication section 13 communicates with one end part of each pressure generating chamber 12 in the longitudinal direction thereof via an ink supply port 14.

The anisotropic etching is executed by using the nature that if the silicon monocrystalline substrate is immersed in an alkaline solution such as KOH, it gradually erodes, a first <111> plane perpendicular to a <110> plane and a second <111> plane forming about 70 degrees with the first <111> plane and forming about 35 degrees with the <110> plane appear, and the etching rate of the <111> plane is about 1/180 that of the <110> plane. By the anisotropic etching, accurate work can be executed based on depth work like a parallelogram formed by the two first <111>planes and the two second <111> planes tilted, and the pressure generating chambers 12 can be arranged at a high density.

In the embodiment, the long sides of each pressure generating chamber 12 are formed by the first <111> planes and the short sides are formed by the second <111> planes. The pressure generating chambers 12 are formed by etching the silicon monocrystalline substrate almost passing through the channel forming substrate 10 to the elastic film 50. The amount of immersing the elastic film 50 in the alkaline solution for etching the silicon monocrystalline substrate is extremely small. Each ink supply port 14 communicating with one end of each pressure generating chamber 12 is formed shallower than the pressure generating chamber 12 for holding the flow passage resistance of ink flowing into the pressure generating chamber 12 constant. That is, the ink supply ports 14 are formed by etching the silicon monocrystalline substrate to an intermediate point in the thickness direction (half etching). The half etching is executed by adjusting the etching time.

A nozzle plate 16 formed with nozzle orifices 15 communicating with the pressure generating chamber 12 on the opposite side of the pressure generating chamber 12 to the ink supply ports 14 is fixedly secured to the opening face side of the channel forming substrate 10 via an adhesive, a thermal-deposited film, etc. The nozzle plate 16 is made of glass ceramics, stainless steel, or the like having a thickness of 0.1–1 mm and a linear expansion coefficient of 2.5–4.5 [$\times 10^{-6}$/°C.] at 300° C. or less, for example. One face of the nozzle plate 16 covers fully one face of the channel forming substrate 10, namely, the nozzle plate 16 also serves as a reinforcing plate for protecting the silicon monocrystalline substrate from shock and external force. The nozzle plate 16 may be formed of a material having substantially the same thermal expansion coefficient as the channel forming substrate 10 has. In this case, the channel forming substrate 10 and the nozzle plate 16 become deformed substantially in the same manner due to heat and thus can be joined easily using a thermosetting adhesive, etc.

The size of each pressure generating chamber 12 for giving ink drop jet pressure to ink and the size of each nozzle orifice 15 for jetting ink drops are optimized in response to the jetted ink drop amount, jet speed, and jet frequency. For example, to record 360 ink drops per inch, the nozzle orifice 15 needs to be made accurately with a diameter of several ten μm.

On the other hand, a lower electrode film 60, for example, about 0.2 μm thick, a piezoelectric film 70, for example, about 1 μm thick, and an upper electrode film 80, for example, about 0.1 μm thick are deposited on the elastic film 50 on the opposite side to the opening face of the channel forming substrate 10 by a process described later, making up a piezoelectric element 300. This piezoelectric element 300 refers to the portion containing the lower electrode film 60, the piezoelectric film 70, and the upper electrode film 80. Generally, one electrode of the piezoelectric element 300 is used as a common electrode and the other electrode and the piezoelectric film 70 are patterned for each pressure generating chamber 12. A portion made up of the electrode and the piezoelectric film 70 patterned where piezoelectric distortion occurs as a voltage is applied to both electrodes is referred to as a piezoelectric active part 320. In the embodiment, the lower electrode film 60 is used as the common electrode of the piezoelectric element 300 and the upper electrode film 80 is used as a discrete electrode of the piezoelectric element 300, but the lower electrode film 60 may be used as a discrete electrode and the upper electrode film 80 may be used as the common electrode for convenience of a drive circuit and wiring. In any case, the piezoelectric active part is formed for each pressure generating chamber 12. Here, the piezoelectric element 300 and the diaphragm displaced by drive of the piezoelectric element 300 are collectively called a piezoelectric actuator. In the above-described example, the elastic film 50 and the lower electrode film 60 act as the diaphragm, but the lower electrode film may also serve as the elastic film.

A reservoir forming substrate 20 having a reservoir section 21 forming at least a part of the reservoir 100 is joined to the piezoelectric element 300 side of the channel forming substrate 10. In the embodiment, the reservoir section 21 is formed in the width direction of the pressure generating chambers 12 piercing the reservoir forming substrate 20 in the thickness direction thereof and is made to communicate with the communication section 13 of the channel forming substrate 10 and forms a part of the reservoir 100 which becomes an ink chamber common to the pressure generating chambers 12 as described above.

Preferably, a material having substantially the same thermal expansion coefficient as the channel forming substrate 10 has, such as glass or ceramic material, is used as the reservoir forming substrate 20. In the embodiment, the reservoir forming substrate 20 is formed using a silicon monocrystalline substrate of the same material as the channel forming substrate 10, so that even if the reservoir forming substrate 20 and the channel forming substrate 10 are bonded at a high temperature using a thermosetting adhesive, they can be bonded reliably as in the case of the above-described nozzle plate 16. Therefore, the manufacturing process can be simplified.

Further, a compliance substrate 30 made up of a sealing film 31 and a fixing plate 32 is joined to the reservoir forming substrate 20. The sealing film 31 is made of a material having low rigidity and flexibility (for example, polyphenylene sulfide (PPS) film of 6 $\mu$m thick) and seals one side of the reservoir section 21. The fixing plate 32 is formed of a hard material of metal, etc., (for example, stainless steel (SUS) of 30 $\mu$m thick, or the like). Since the area of the fixing plate 32 opposed to the reservoir 100 forms an opening section 33 made by completely removing a part of the seal plate 32 in the thickness direction thereof, one side of the reservoir 100 is sealed only with the sealing film 31 having flexibility and becomes a flexible section 22 that can become deformed as internal pressure changes.

An ink introduction port 25 for supplying ink to the reservoir 100 is formed on the compliance substrate 30 on the outside substantially at the center in the longitudinal direction of the reservoir 100. Further, the reservoir forming substrate 20 is formed with an ink introduction passage 26 for making the ink introduction port 25 and the side wall of the reservoir 100 communicate with each other. In the embodiment, ink is supplied to the reservoir 100 through one ink introduction port 25 and one ink introduction passage 26, but the scope of the invention is not limited to it. For example, more than one ink introduction port and more than one ink introduction passage may be provided in response to any desired ink supply amount or the opening area of the ink introduction port may be enlarged for enlarging the ink flow passage.

Normally, when ink is supplied from the ink introduction port 25 to the reservoir 100, pressure change occurs in the reservoir 100, for example, due to an ink flow at the driving time of the piezoelectric element 300 or ambient heat, etc. However, one side of the reservoir 100 is sealed only with the sealing film 31 and becomes the flexible section 22 as described above, thus the flexible section 22 becomes deflection-deformed for absorbing the pressure change. Therefore, the inside of the reservoir 100 is always held at a constant pressure. Other portions are held in sufficient strength by means of the fixing plate 32. In the embodiment, the number of the substrates forming the reservoir 100, etc., can be decreased, thus the material and assembly costs, etc., can be reduced.

On the other hand, in a state in which a space is provided to such an extent that motion of the piezoelectric element 300 is not inhibited, the area of the reservoir forming substrate 20 opposed to the piezoelectric element 300 is formed with a piezoelectric element holding section 24 capable of hermetically sealing the space, and at least the piezoelectric active part 320 of the piezoelectric element 300 is hermetically sealed in the piezoelectric element holding section 24. In the embodiment, the piezoelectric element holding section 24 is formed in size covering a plurality of piezoelectric elements 300 placed side by side in a width direction.

Thus, the reservoir forming substrate 20 forms the reservoir 100 and also serves as a capping member for insulating the piezoelectric elements 300 from the external environment; it can prevent the piezoelectric elements 300 from being destroyed due to the external environment of a moisture content, etc. In the embodiment, the inside of the piezoelectric element holding section 24 is sealed. However, for example, the space in the piezoelectric element holding section 24 is evacuated or is placed in a nitrogen or argon atmosphere, etc., whereby the inside of the piezoelectric element holding section 24 can be held at low humidity and destruction of the piezoelectric elements 300 can be prevented more reliably.

In the embodiment, the piezoelectric film 70 and the upper electrode film 80 of the piezoelectric element 300 thus hermetically sealed by means of the piezoelectric element holding section 24 are extended from one end part of the pressure generating chamber 12 in the longitudinal direction thereof to the outside of the reservoir forming substrate 20 on the channel forming substrate 10 and are connected to external wiring 40, such as a flexible cable, on an exposed portion 10*a* where the face of the joint side of the channel forming substrate 10 to the reservoir forming substrate 20 is exposed. That is, wiring is extended from the piezoelectric element 300 to the outside of the reservoir forming substrate 20, whereby the piezoelectric element 300 and the external wiring can be connected easily.

With the described ink jet recording head of the embodiment, ink is taken in through the ink introduction port 25 connected to external ink supply means (not shown) and the inside of the recording head from the reservoir 100 to the nozzle orifices 15 is filled with ink, then a voltage is applied to the part between the lower electrode film 60 and the upper electrode film 80 corresponding to each pressure generating chamber 12 according to a record signal from an external drive circuit (not shown) for deflection-deforming the elastic film 50, the lower electrode film 60, and the piezoelectric film 70, thereby raising pressure in the corresponding pressure generating chamber 12 and jetting an ink drop through the corresponding nozzle orifice 15.

Figure 3A:
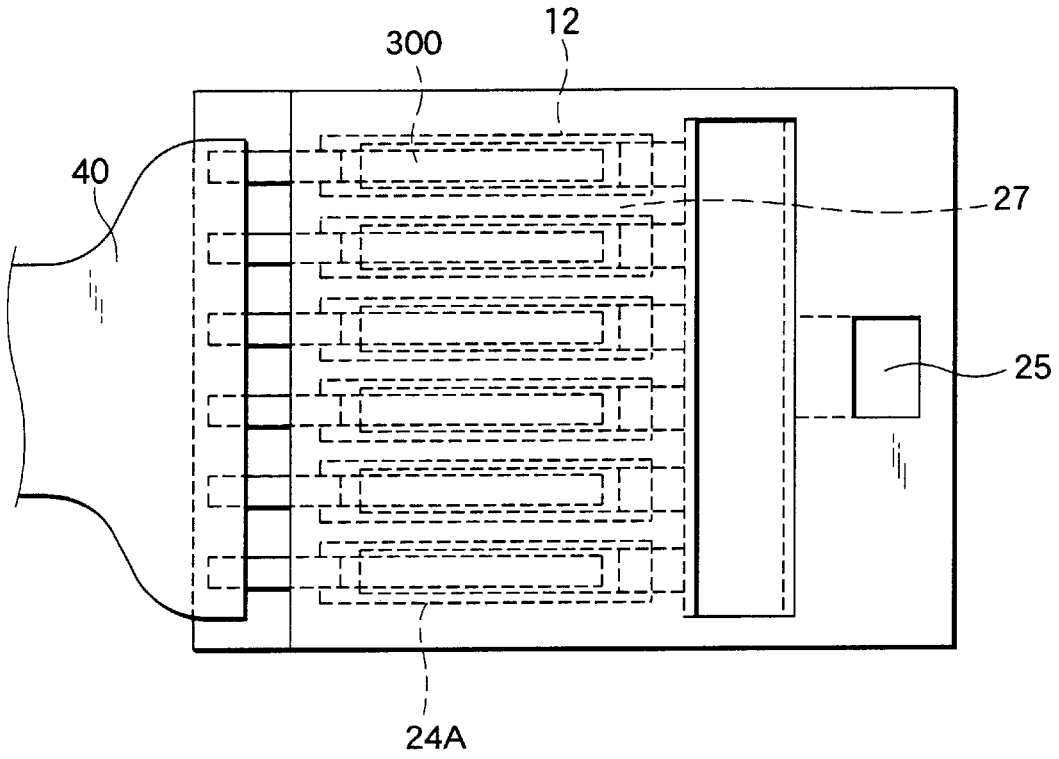
FIGS. 3A and 3B are a plan view and a sectional view to show a modified example of the ink jet recording head according to the first embodiment of the invention.
Figure 3B:
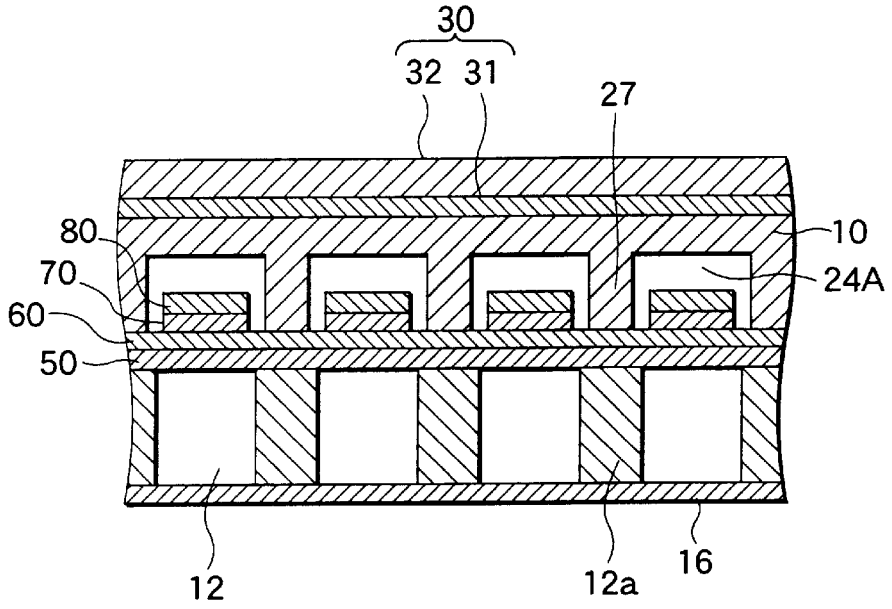

In the embodiment, the piezoelectric element holding section 24 of the reservoir forming substrate 20 is formed so as to cover all piezoelectric elements 300 placed side by side in the width direction, but the scope of the invention is not limited to it. For example, as shown in FIGS. 3A and 3B, the piezoelectric element holding section 24 may be divided by partition walls 27 into separate piezoelectric element holding sections 24A for hermetically sealing the piezoelectric elements 300 with the corresponding piezoelectric element holding sections 24A, whereby the partition wall 27 is joined to the portion of the channel forming substrate 10 corresponding to a side wall 12*a* of each pressure generating chamber 12, the rigidity of the peripheral wall of the pressure generating chamber 12 is enhanced, and falling down of the peripheral wall when the piezoelectric element 300 is driven can be suppressed. According to the composition, destruction of the piezoelectric element 300 can also be prevented as in the above-described embodiment, needless to say.

Figure 4:
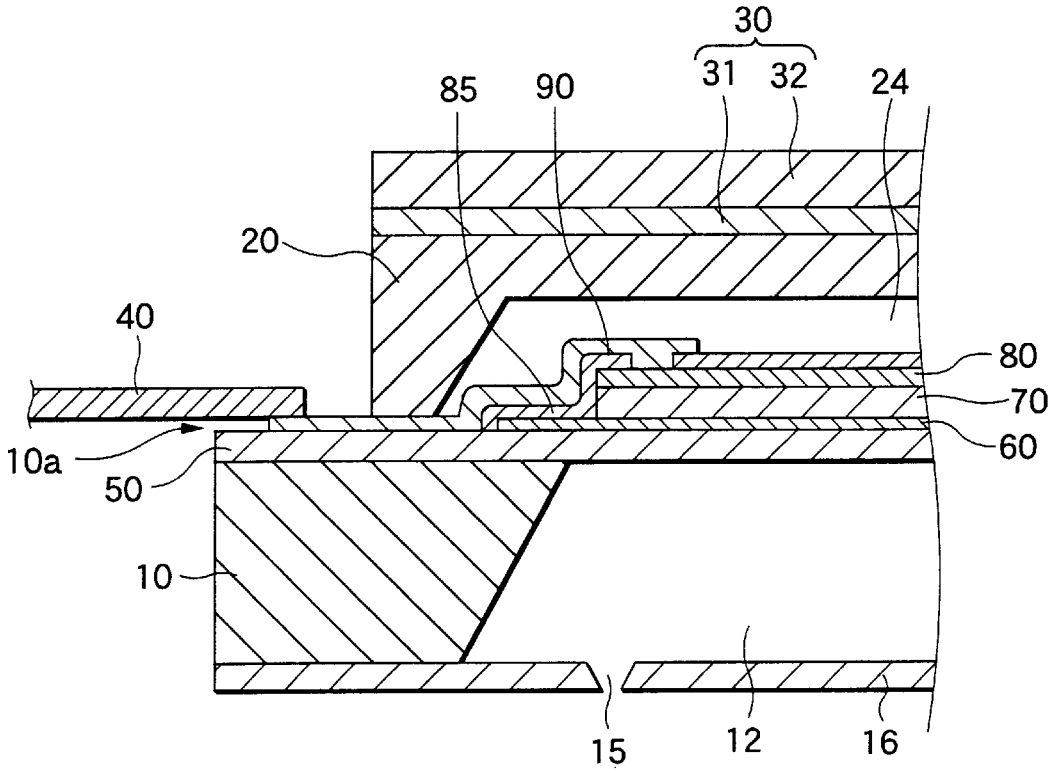
FIG. 4 is a sectional view to show a modified example of the ink jet recording head according to the first embodiment of the invention.

In the embodiment, the piezoelectric film 70 and the upper electrode film 80 are extended to the outside of the reservoir forming substrate 20 and the upper electrode film 80 and the external wiring 40 are connected, but the scope of the invention is not limited to it. For example, as shown in FIG. 4, the piezoelectric elements 300 may be patterned in the area facing the pressure generating chambers 12 and a lead electrode 90 may be extended from the upper electrode film 80 via an insulation film 85 to the exposed portion 10*a* outside the reservoir forming substrate 20 and be connected to the external wiring 40 in the proximity of the end portion thereof.

Thus, the lead electrode 90 is extended from the upper electrode film 80 to the outside of the reservoir forming substrate 20 and is connected to the external wiring 40, whereby a gap with the elastic film 50 when the reservoir forming substrate 20 is bonded becomes only several $\mu$m and the piezoelectric elements 300 can be hermetically sealed in the piezoelectric element holding section 24 more reliably.

Figure 5:
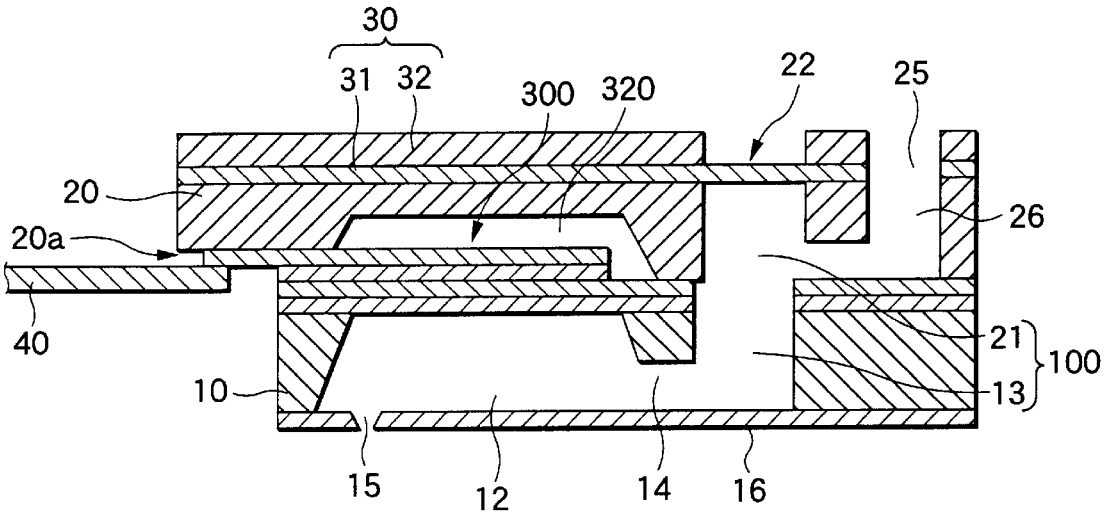
FIG. 5 is a sectional view to show a modified example of the ink jet recording head according to the first embodiment of the invention.

In the embodiment, the channel forming substrate 10 is so formed as to be larger than the reservoir forming substrate 20 and the piezoelectric elements 300 and the external wiring 40 are connected on the exposed portion 10*a* of the channel forming substrate 10, but the scope of the invention is not limited to it. For example, as shown in FIG. 5, the reservoir forming substrate 20 may be so formed as to be larger than the channel forming substrate 10, the face on the joint side of the reservoir forming substrate 20 to the channel forming substrate 10 may be exposed to form an exposed portion 20*a*, and the piezoelectric elements 300 and the external wiring may be connected on the exposed portion 20*a*.

Figure 6A:
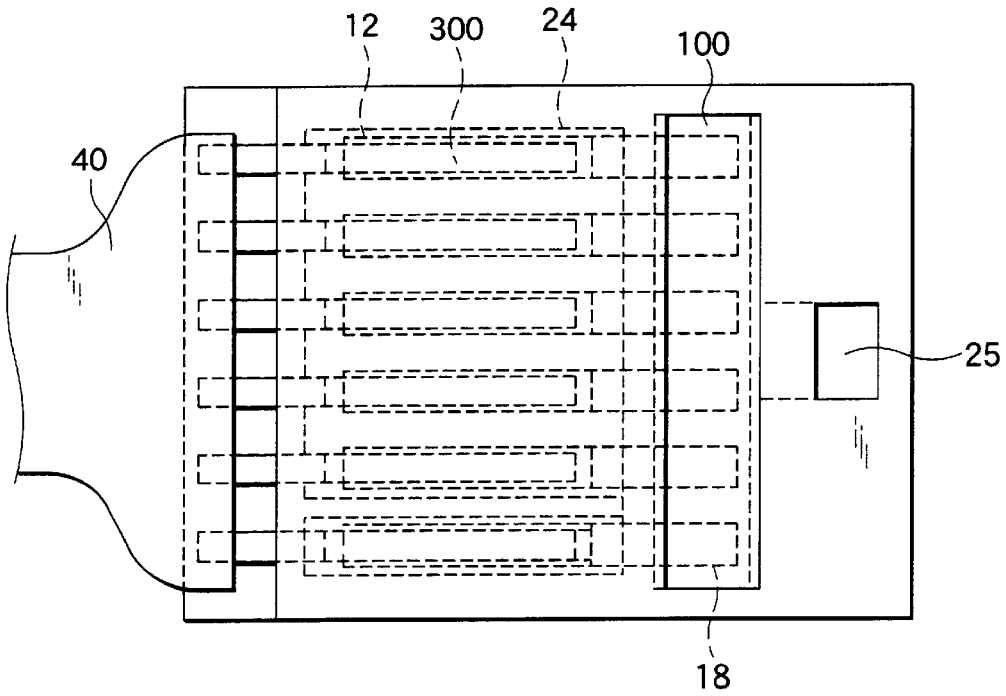
FIGS. 6A and 6B is a plan view and a sectional view to show a modified example of the ink jet recording head according to the first embodiment of the invention.
Figure 6B:
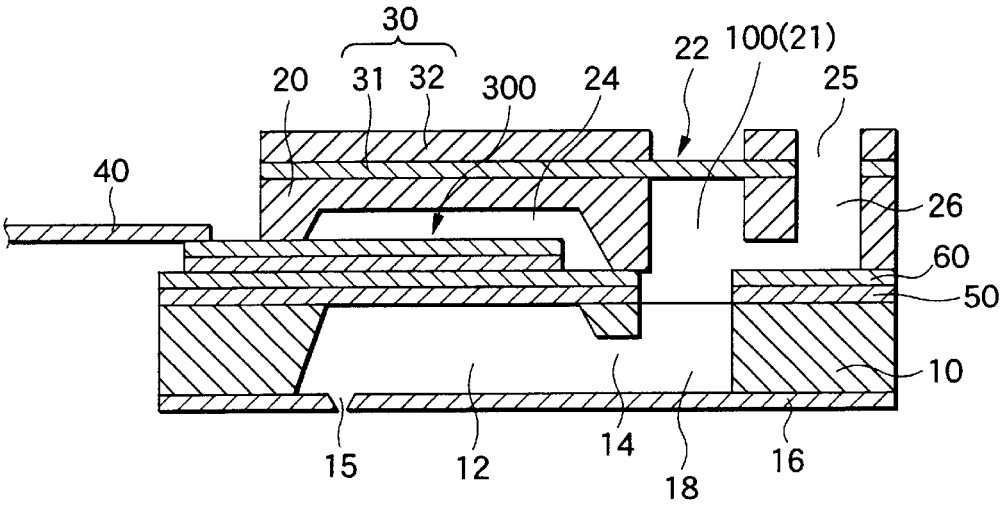

Further, in the embodiment, the communication section 13 forming a part of the reservoir 100 via the ink supply ports 14 is placed on the end part side of the channel forming substrate 10 opposite to the nozzle orifices 15 of the pressure generating chambers 12, but the scope of the invention is not limited to it. For example, as shown in FIGS. 6A and 6B, the reservoir 100 basically may be formed only of the reservoir section 21 of the reservoir forming substrate 20, and the pressure generating chambers 12 and the reservoir 100 may be made to communicate with each other via a communication passage 18 relatively narrower than the flow passage of the reservoir 100 in the channel forming substrate 10. In the composition, when ink is supplied to the pressure generating chamber 12, the flow velocity of the ink is maintained, so that mixing of bubbles can be prevented and good ink jetting can be executed.

Figure 7A:
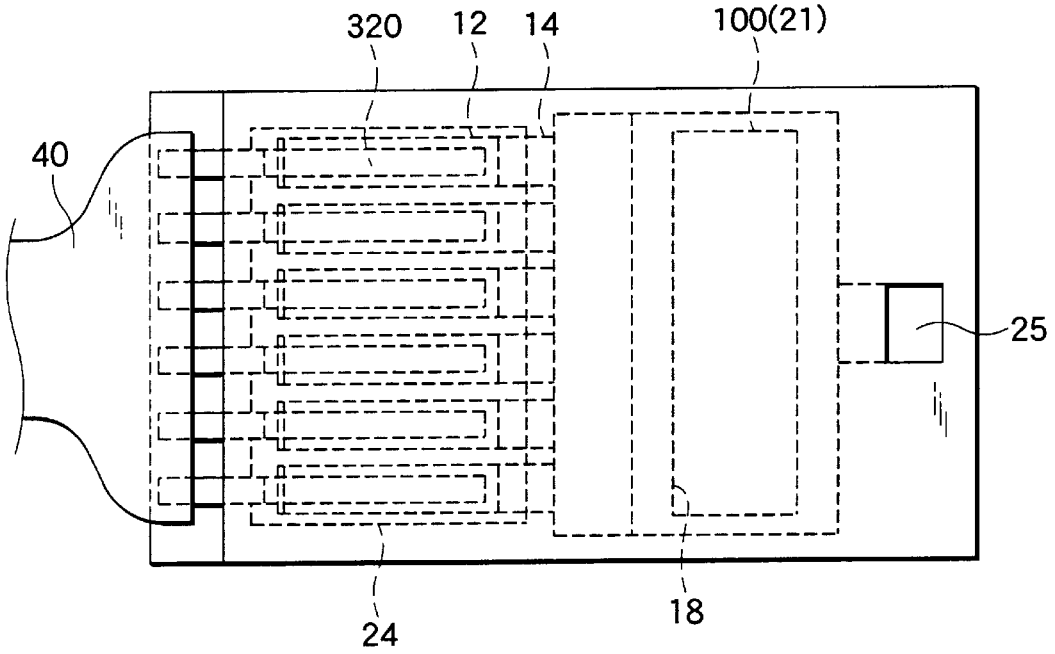
FIGS. 7A and 7B are a plan view and a sectional view of an ink jet recording head according to a second embodiment of the invention.
Figure 7B:
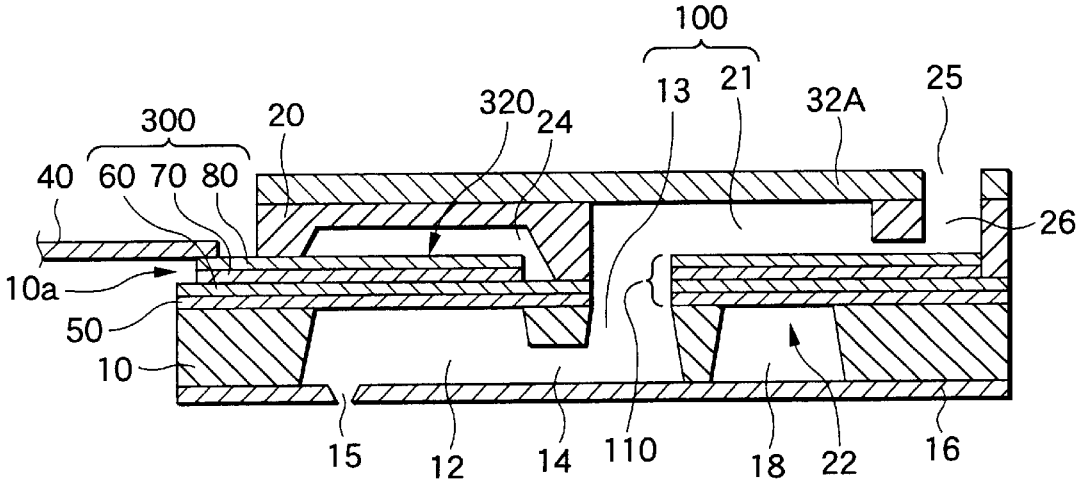

FIGS. 7A and 7B are a plan view and a sectional view of an ink jet recording head according to a second embodiment of the invention.

The second embodiment is an example wherein a flexible section 22 is placed in a channel forming substrate 10 rather than in the area of a reservoir section 21 opposite to the channel forming substrate 10.

Particularly, as shown in FIGS. 7A and 7B, in the embodiment, the channel forming substrate 10 in the area corresponding to the reservoir section 21 is formed with a through section 18 not communicating with pressure generating chambers in the width direction of the pressure generating chambers, and at least the space between the through section 18 and the reservoir section 21 is closed with a flexible film 110 that can be elastically deformed in the thickness direction thereof, forming the flexible section 22.

On the other hand, a fixing plate 32A made of a hard material of metal, etc., such as stainless steel (SUS), is joined to the face on the opposite side of a reservoir forming substrate 20 to the channel forming substrate 10, sealing one side of a reservoir 100.

If pressure change occurs in the reservoir 100 as a piezoelectric element 300 is driven or for any other reason, like the above-described flexible section 22, the flexible film 110 becomes elastically deformed, thereby absorbing the pressure change, whereby the internal pressure of the reservoir 100 is always suppressed to a given value or less and a good ink jet characteristic is maintained.

In the embodiment, an elastic film 50 and a lower electrode film 60, a piezoelectric film 70, and an upper electrode film 80 making up the piezoelectric element 300 are placed on the channel forming substrate 10 in the area corresponding to the reservoir section 21, and become the flexible film 110 in the area facing the through section 18. The flexible film 110 made up of the films is about 3 $\mu$m thick and functions sufficiently as a compliance section.

Preferably, the flexible film 110 contains a film having a tensile stress in all plane direction. Particularly, preferably the stress of the whole films making up the flexible film 110 is strong in the tensile direction and does not buckle, so that excessive deformation of the flexible film 110 is suppressed and destruction of the flexible film 110 can be prevented.

In the embodiment, the flexible film 110 is made up only of the elastic film 50 and the films making up the piezoelectric element 300 and can be formed as the piezoelectric element 300 is formed. The through section 18 can also be etched together with the pressure generating chambers 12 and be formed and thus can be formed easily without increasing the manufacturing steps.

In the embodiment, the flexible film 110 consists of the elastic film 50, the lower electrode film 60, the piezoelectric film 70, and the upper electrode film 80, but the scope of the invention is not limited to it. For example, the flexible film 110 may be made up of the elastic film 50 and at least one of the layers making up the piezoelectric element 300; in any way, it may be a film having flexibility and a predetermined strength. However, when the elastic film is formed of silicon dioxide as in the embodiment, if the flexible film 110 is made only of an elastic film, a low strength is provided; the composition is not preferred. A separate film made of any other material may be provided as the flexible film 110, needless to say.

Figure 8A:
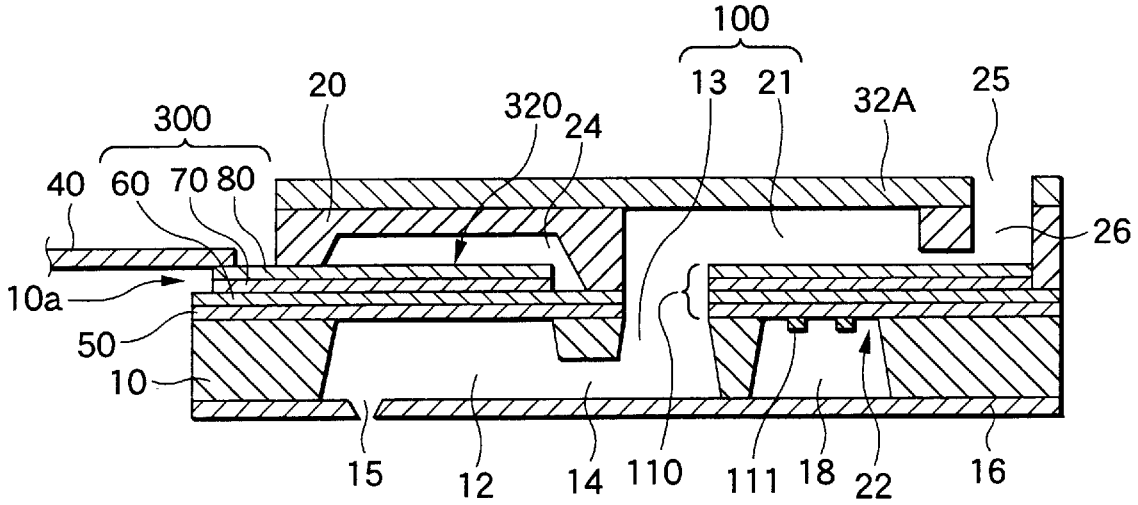
FIGS. 8A and 8B are a sectional view of an ink jet recording head and a schematic diagram of a flexible film according to a third embodiment of the invention.
Figure 8B:
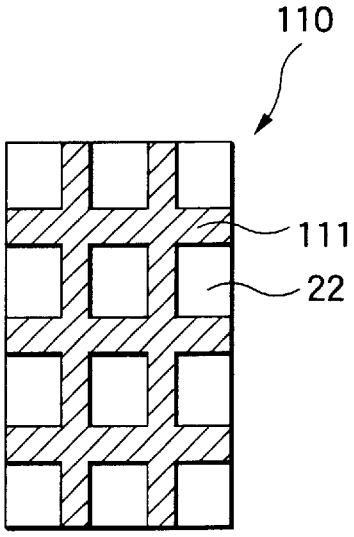

FIGS. 8A and 8B are a sectional view of the main part of an ink jet recording head and a schematic diagram of a flexible film according to a third embodiment of the invention.

As shown in FIGS. 8A and 8B, the third embodiment is similar to the second embodiment except that a beam member 111 made up of projection bars extended in a plane direction is provided on the surface on the channel forming substrate side of a flexible film 110 which becomes a flexible section 22.

The beam member 111 is provided for enhancing the strength of the flexible film 110. For example, in the embodiment, the beam member 111 is provided like a grid over the whole surface of the flexible film 110 as shown in FIG. 8B. The area of the flexible film 110 may be determined appropriately in response to the conditions of the material, film thickness, etc., of the flexible film 110 so as to provide any desired strength for the flexible film 110. At this time, to reliably absorb pressure change in a reservoir 100, preferably the portion of the flexible film 110 which becomes the actual flexible part where the beam member 111 is not formed holds an area at least 10 times the area of a pressure generating chamber.

The formation method of the beam member 111 is not limited; for example, to make a through section 18 in a channel forming substrate 10, a predetermined mask pattern is used for etching, whereby a portion where a part of the channel forming substrate 10 is left may be used as the beam member 111.

Thus, the flexible film 110 is provided with the beam member 111, whereby the strength of the flexible film 110 can be increased. Therefore, the strength and compliance of the flexible film 110 can be adjusted easily and with high accuracy by adjusting the area of the beam member 111.

The form of the beam member 111 is not limited to a grid; it may be any other form, such as a slanting grid, if the form is capable of holding predetermined compliance. Of course, the strength and compliance of the flexible film 110 may be adjusted by changing the size of the through section 18.

Figure 9A:
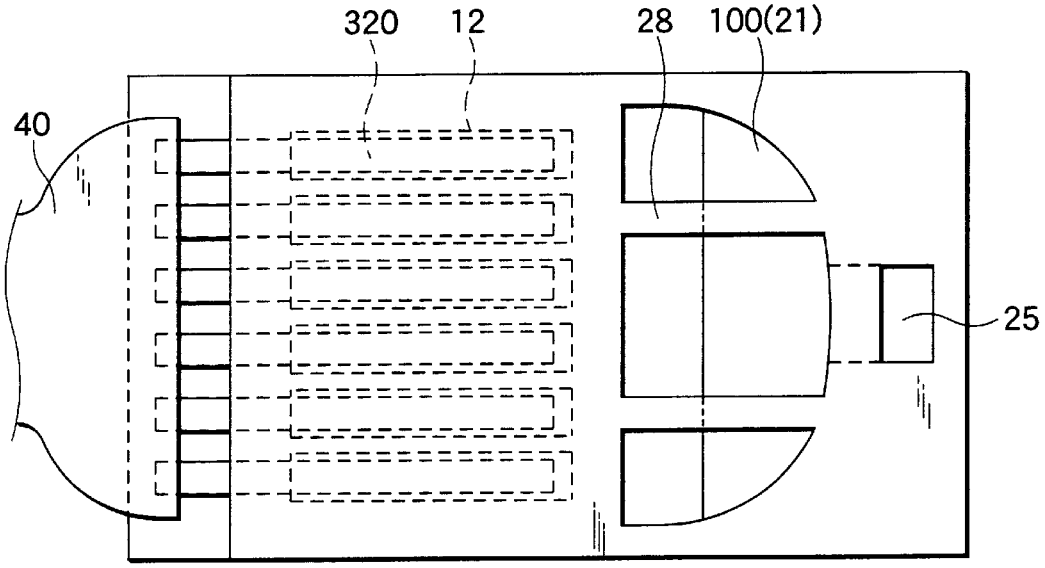
FIGS. 9A and 9B are a plan view and a sectional view of an ink jet recording head according to a fourth embodiment of the invention.
Figure 9B:
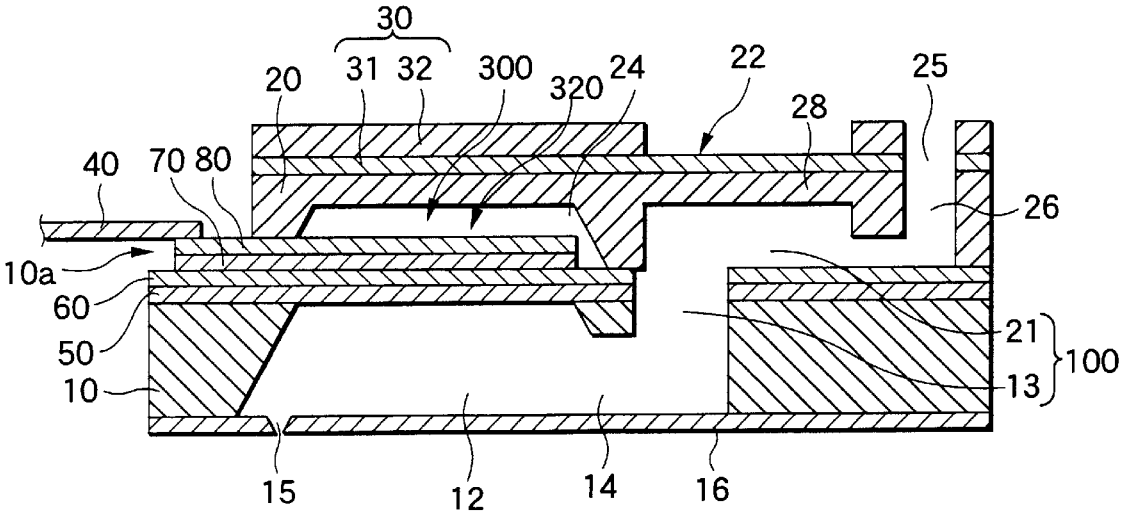

FIGS. 9A and 9B are a plan view and a sectional view of an ink jet recording head according to a fourth embodiment of the invention.

As shown in FIGS. 9A and 9B, the fourth embodiment is similar to the first embodiment except that a reservoir section 21 forming a part of a reservoir 100 is formed with a reinforcing member 28 for holding the rigidity of a reservoir forming substrate 20.

That is, in the fourth embodiment, the reservoir section 21 is defined in the reservoir forming substrate 20 and at least one reinforcing member 28 (for example, two beam-like reinforcing members 28 in the embodiment) is placed between side walls facing each other. The reinforcing member 28 is formed along the longitudinal direction of a piezoelectric element 300 on the surface side opposite to the joint face of the reservoir section 21 to a channel forming substrate 10. The reinforcing member 28 is formed by half-etching the reservoir forming substrate 20 from the joint face side to the channel forming substrate 10, and is thinner than other portions. Preferably, the reinforcing member 28 is made an area as wide as possible in the area range to such an extent that a flexible section 22 is capable of uniformly holding the internal pressure of the reservoir 100.

Thus, in the embodiment, the beam-like reinforcing members 28 are placed between the side walls defining the reservoir 100 and the rigidity of the reservoir section 21 is enhanced. Thus, if the volume of the reservoir section 21 is made relatively large, deformation such as a warp of the reservoir forming substrate caused by a thermal stress at the installation time can be prevented and a crack of the reservoir forming substrate caused by the deformation can be prevented. Therefore, the durability and reliability of the head can be enhanced.

Figure 10:
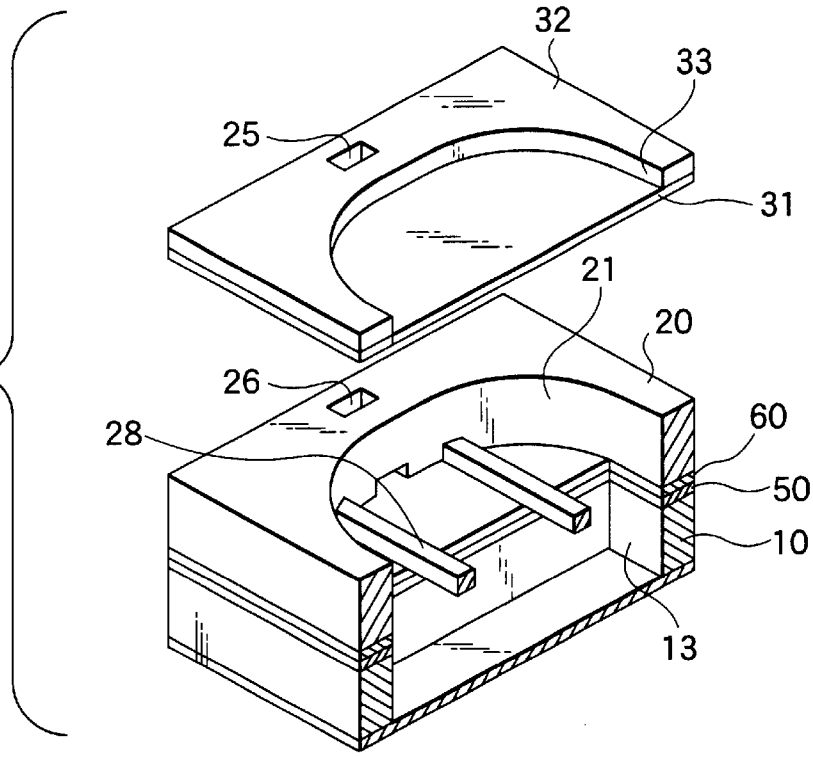
FIG. 10 is a perspective view to show a modified example of the ink jet recording head according to the fourth embodiment of the invention.

In the embodiment, the reinforcing members 28 are formed on the surface side opposite to the joint face of the reservoir forming substrate 20 to the channel forming substrate 10, but the scope of the invention is not limited to it. For example, as shown in FIG. 10, the reinforcing members 28 may be formed on the joint face side of the reservoir forming substrate 20 to the channel forming substrate 10.

Figure 11:
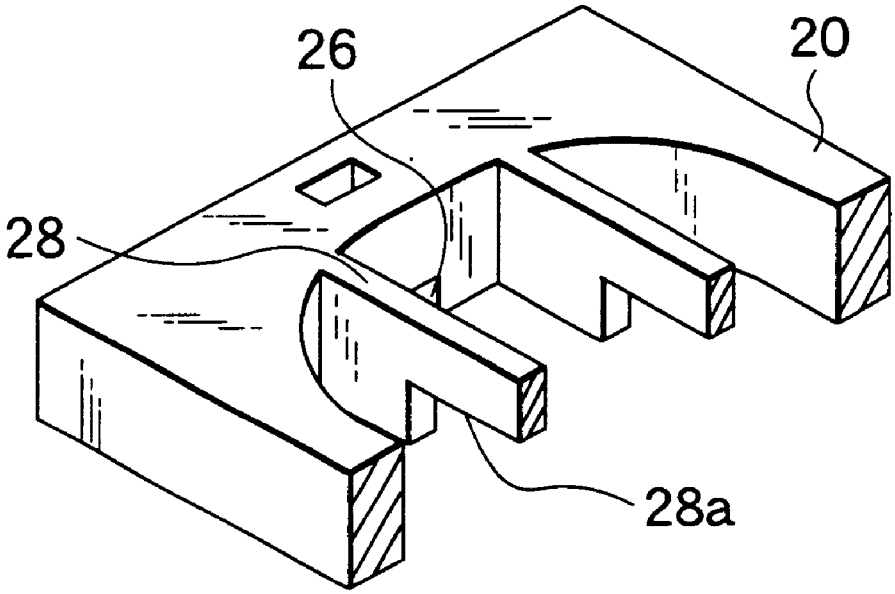
FIG. 11 is a perspective view to show a modified example of the ink jet recording head according to the fourth embodiment of the invention.

In the embodiment, the whole reinforcing member 28 is made thinner than other portions, but the scope of the invention is not limited to it. For example, as shown in FIG. 11, the reinforcing member 28 basically may be formed with the same thickness as the reservoir forming substrate 20 and a part of the joint face side to the channel forming substrate 10 may be made a removal part 28*a* provided by removing a part in the thickness direction. By adopting such a structure, the strength of the reservoir forming substrate 20 can be furthermore enhanced and deformation caused by heat at the installation time can be prevented reliably without degrading the function of the reservoir 100.

Further, in the embodiment, the two reinforcing members 28 are provided, but the scope of the invention is not limited to it. For example, one or three or more reinforcing members 28 may be provided. In any way, the form of the reinforcing member 28 may be a form capable of holding the compliance of the flexible section 22 to such an extent that internal pressure change of the reservoir 100 can be absorbed.

Figure 12:
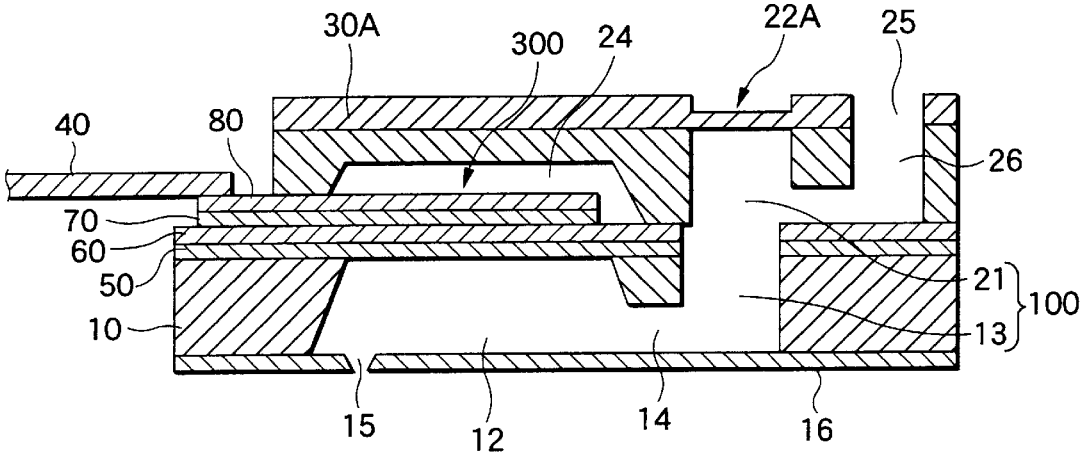
FIG. 12 is a sectional view of an ink jet recording head according to a fifth embodiment of the invention.

FIG. 12 is a sectional view of the main part of an ink jet recording head according to a fifth embodiment of the invention.

The fifth embodiment is an example wherein a compliance substrate 30A made of one member is placed on a channel forming substrate 10. That is, as shown in FIG. 12, the fifth embodiment is similar to the first embodiment except that a through hole which becomes an ink introduction port 25 is made on the outside of a flexible section 22A having flexibility provided by removing a part of the area facing a reservoir 100 in the thickness direction of the area. Preferably, the material of the compliance substrate 30A is a resin material having flexibility, such as fluororesin, silicone family resin, or silicone rubber, so that the compliance substrate 30A can be formed easily.

The manufacturing method of the compliance substrate 30A is not limited; for example, the compliance substrate 30A can be formed by forming a resin layer of a predetermined thickness on a silicon monocrystalline substrate forming a reservoir forming substrate 20, then forming the reservoir 100, etc., on the reservoir forming substrate 20 by etching, etc., and further etching a part, etc., in the thickness direction of the area of the resin layer opposed to the reservoir 100.

Figure 13:
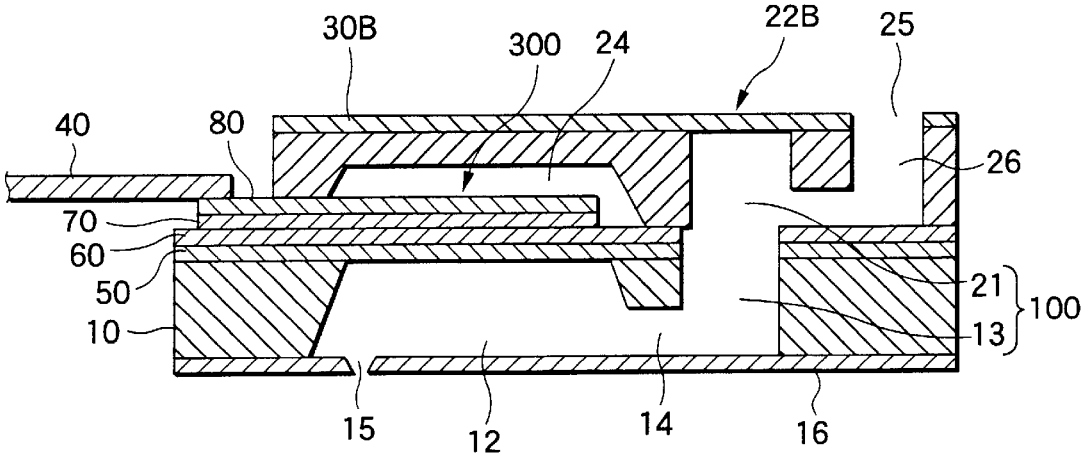
FIG. 13 is a sectional view to show a modified example of the ink jet recording head according to the fifth embodiment of the invention.

In the embodiment, the compliance substrate 30A is formed of a resin material, but the scope of the invention is not limited to it. For example, as shown in FIG. 13, a compliance substrate 30B may be made of a thin film of metal, ceramic, or the like about 1–10 $\mu$m thick. In this case, the area opposed to the reservoir 100 can be made a flexible section 22B having flexibility without removing a part in the thickness direction. Therefore, the head can be manufactured more easily.

Figure 14A:
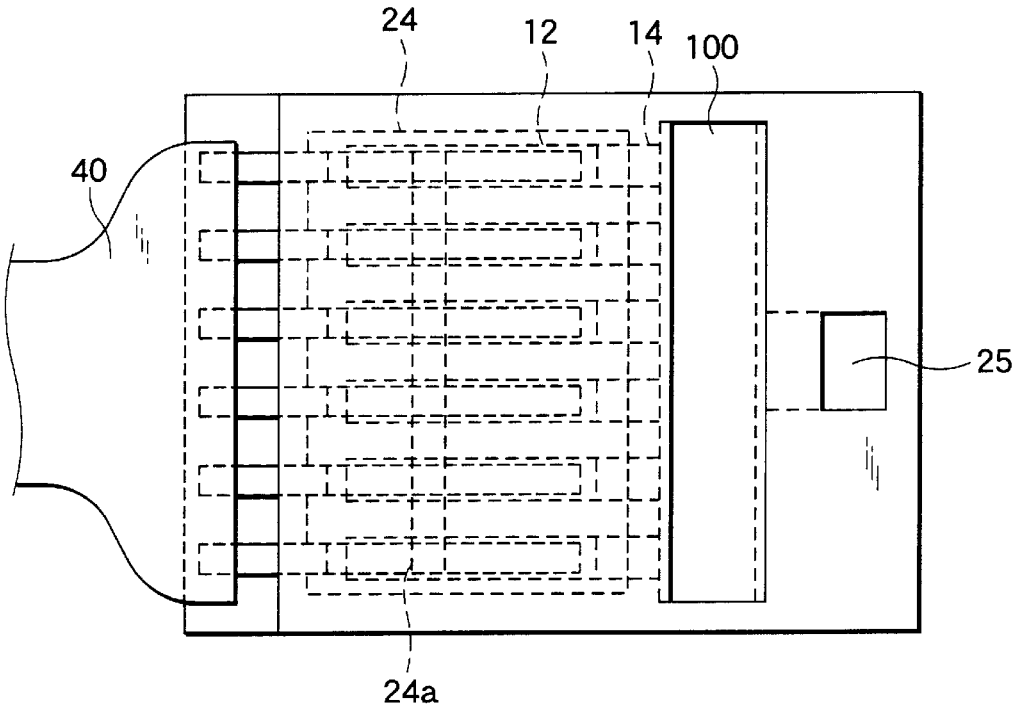
FIGS. 14A and 14B are a plan view and a sectional view of an ink jet recording head according to a sixth embodiment of the invention.
Figure 14B:
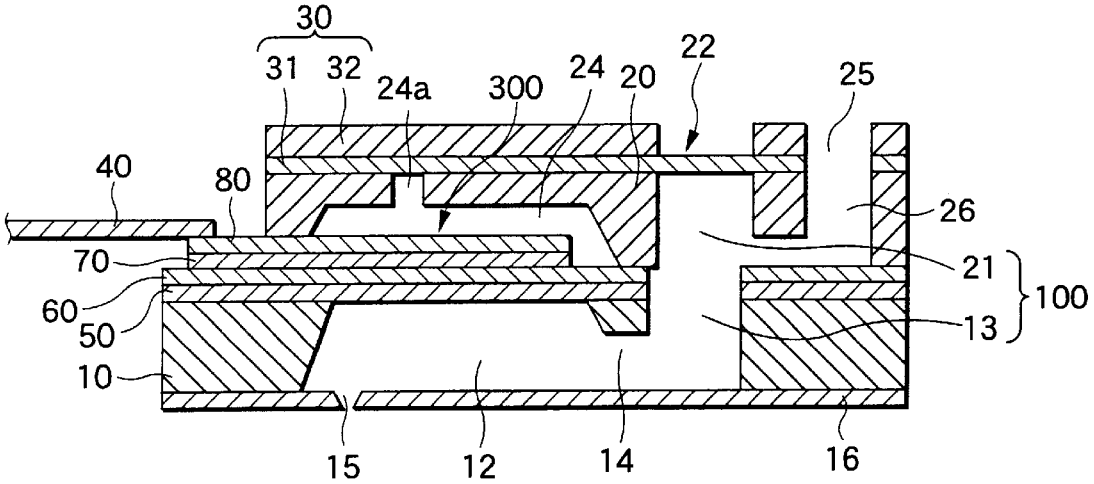

FIGS. 14A and 14B are a plan view and a sectional view of an ink jet recording head according to a sixth embodiment of the invention.

As shown in FIGS. 14A and 14B, the sixth embodiment is similar to the first embodiment except that a detection through hole 24*a* for detecting displacement of each piezoelectric element 300 is made so as to across the pressure generating chambers 12 in such portion corresponding to the piezoelectric elements 300 in such area of a reservoir forming substrate 20 opposed to a piezoelectric element holding section 24.

In the composition, displacement of each piezoelectric element 300 can be checked, for example, using laser beam, etc., before a compliance substrate 30 is joined onto the reservoir forming substrate 20. Therefore, a failure of the piezoelectric element 300 can be found before the head is completed; the head manufacturing efficiency can be enhanced. Since the detection through hole 24*a* is sealed with the compliance substrate 30, the piezoelectric element holding section 24 can be held in a hermetic seal state as in the first embodiment.

The detection through hole 24*a* is not limited in size and may be formed at least in the area facing the piezoelectric elements 300. Therefore, in the embodiment, it is made like a groove in the row direction of the pressure generating chambers 12. However, for example, the detection through hole 24*a* may be made a round hole for each piezoelectric element 300 or the whole piezoelectric element holding section may be made the through hole.

Figure 15:
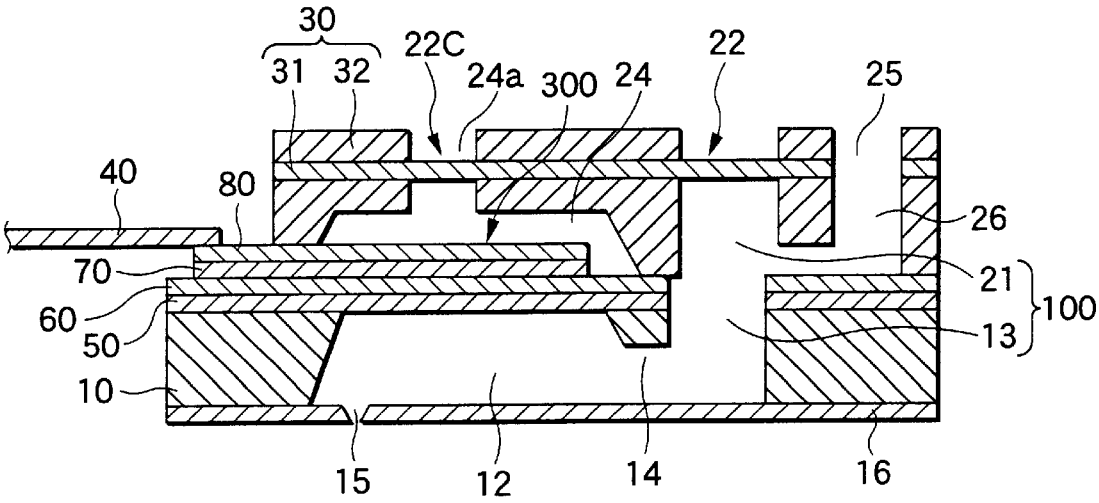
FIG. 15 is a sectional view to show a modified example of the ink jet recording head according to the sixth embodiment of the invention.

In the embodiment, the detection through hole 24*a* is sealed with the compliance substrate 30, but the scope of the invention is not limited to it. For example, as shown in FIG. 15, the detection through hole 24*a* may be sealed only with a sealing film 31 having flexibility, namely, a fixing plate 32 in the area facing the detection through hole 24*a* may be removed to form a flexible section 22C. Thus, if pressure change occurs in the piezoelectric element holding section 24, the flexible section 22C becomes deformed, thereby absorbing the pressure change; the inside of the piezoelectric element holding section 24 can always be held at a constant pressure.

The sealing film 31 which becomes the flexible section 22C of the piezoelectric element holding section 24 may be formed of a light transparent member, such as acrylic resin, so that displacement of each piezoelectric element 300 can be detected with the piezoelectric element 300 hermetically sealed in the piezoelectric element holding section 24. That is, the piezoelectric elements 300 can be inspected at all times.

Figure 16A:
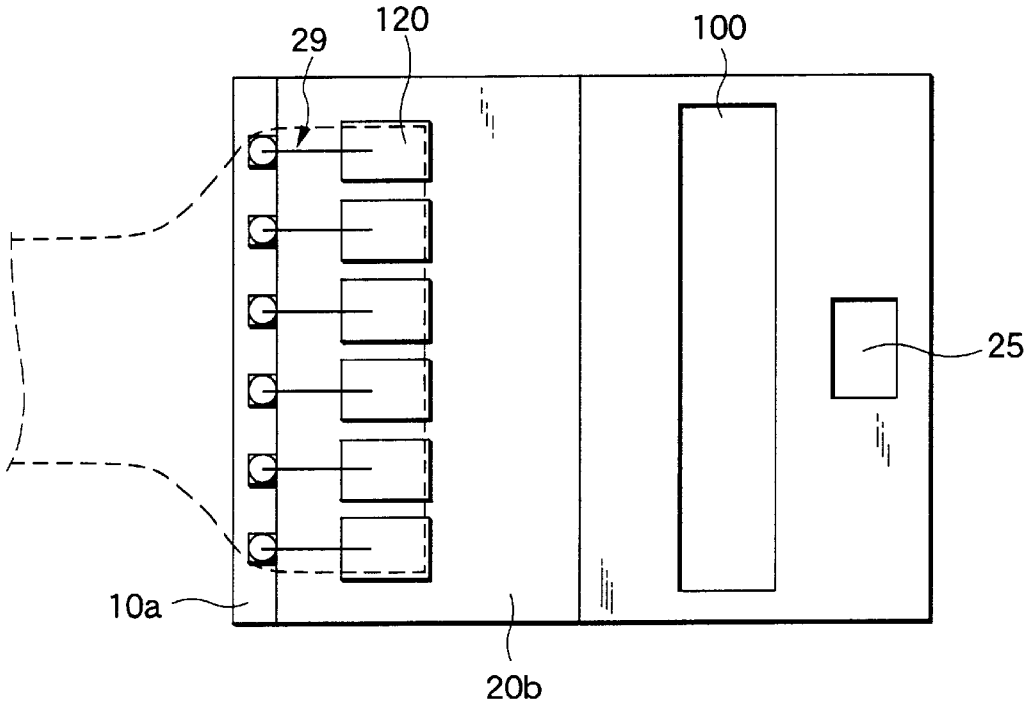
FIGS. 16A and 16B are a plan view and a sectional view of an ink jet recording head according to a seventh embodiment of the invention.
Figure 16B:
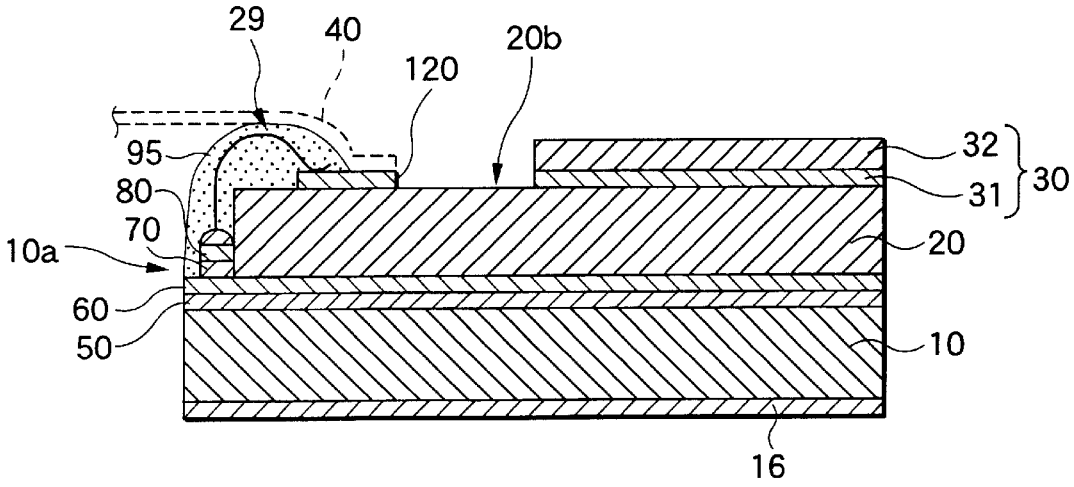

FIGS. 16A and 16B are a plan view and a sectional view of an ink jet recording head according to a seventh embodiment of the invention.

The seventh embodiment is another example of the wiring method of a piezoelectric element 300. As shown in FIG. 16, a compliance substrate 30 is not placed in a part on the opposite side of a reservoir forming substrate 20 to a reservoir 100 to form an exposed portion 20*b* where the surface of the reservoir forming substrate 20 is exposed. Wiring 29 is extended onto the exposed portion 20*b* of the reservoir forming substrate 20 by wire bonding from an upper electrode film 80 of the piezoelectric element 300 extended to the outside of the reservoir forming substrate 20, and the end part of the extended wiring 29 is made an installation section 120 for connecting the piezoelectric element 300 and external wiring 40. Further, the outside is molded by an insulating member 95 of epoxy, etc., for example, for providing electric insulation. The seventh embodiment is similar to the first embodiment in other points.

To connect the piezoelectric element 300 and the external wiring 40 on an exposed portion where the surface of a channel forming substrate 10 is exposed as formerly, the exposed portion requires a width of about 2.2–3.0 mm and the dimensions of the head become a little large. In contrast, in the embodiment, the wiring 29 is extended onto the exposed portion 20*b* of the reservoir forming substrate 20 by wire bonding from an exposed portion 10*a* of a channel forming substrate 10 and is connected to the external wiring 40. Thus, the exposed portion 10*a* of the channel forming substrate 10 can be made about 0.2 mm wide and the dimensions of the recording head can be made smaller. Of course, according to the composition, advantages similar to those of the first embodiment can also be provided.

Figure 17A:
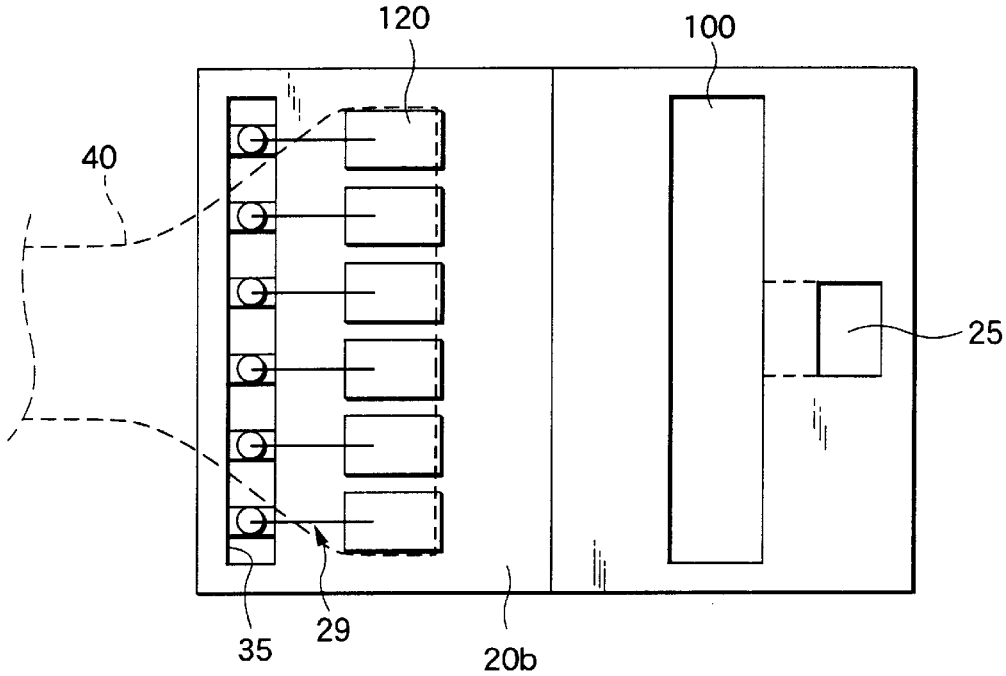
FIGS. 17A and 17B are a plan view and a sectional view of an ink jet recording head according to an eighth embodiment of the invention.
Figure 17B:
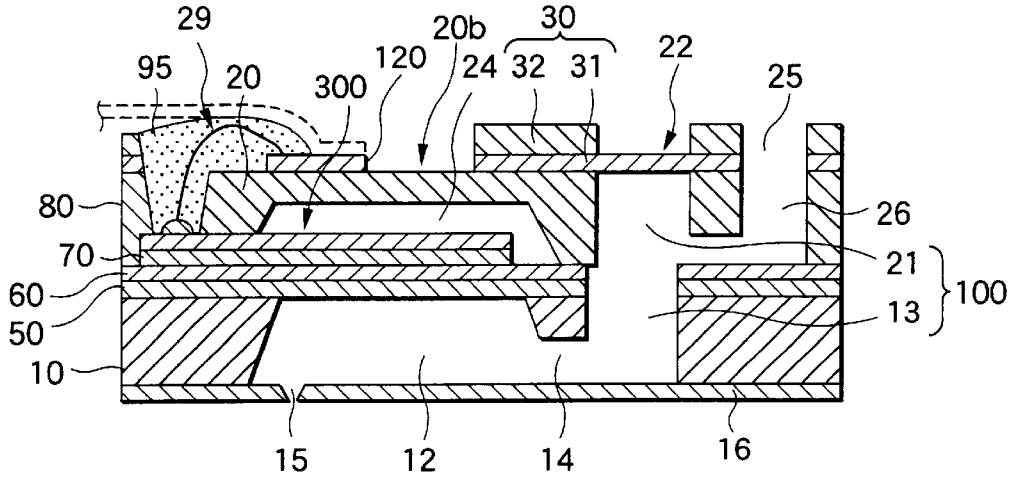

FIGS. 17A and 17B are a plan view and a sectional view of an ink jet recording head according to an eighth embodiment of the invention.

The eighth embodiment is an example wherein a reservoir forming substrate 20 is formed with a through groove via which a piezoelectric element 300 and external wiring are connected. Particularly, as shown in FIGS. 17A and 17B, in the embodiment, a piezoelectric film 70 and an upper electrode film 80 of the piezoelectric element 300 are extended to the top of the peripheral wall of a pressure generating chamber 12 in the longitudinal direction thereof on the side of a nozzle orifice 15 and are sandwiched between a channel forming substrate 10 and the reservoir forming substrate 20. A part of the joint face of the reservoir forming substrate 20 to a compliance substrate 30 is made an exposed portion 20*b* provided by exposing the surface as in the seventh embodiment, and a through groove 35 extended in the direction in which the pressure generating chambers 12 are placed side by side is formed in the area corresponding to the exposed portion 20*b* and facing the upper electrode film 80 of the piezoelectric element 300. Wiring 29 is extended by wire bonding onto the surface of the reservoir forming substrate 20 through the through groove 35 from the upper electrode film 80 of each piezoelectric element 300, and the end part of the wiring 29 is made an installation section 120 for connecting the piezoelectric element 300 and external wiring 40 such as a flexible cable.

In the composition, the wiring 29 is extended via the through groove 35, thus eliminating the need for providing the exposed portion 10*a* at the end of the channel forming substrate 10 or the exposed portion 20*a* at the end portion of the reservoir forming substrate 20; the head can be more miniaturized.

In the embodiment, the through groove 35 is formed like a groove over the row of the piezoelectric elements 300, but the scope of the invention is not limited to it. For example, a through hole may be made separately for each piezoelectric element 300.

Figure 18A:
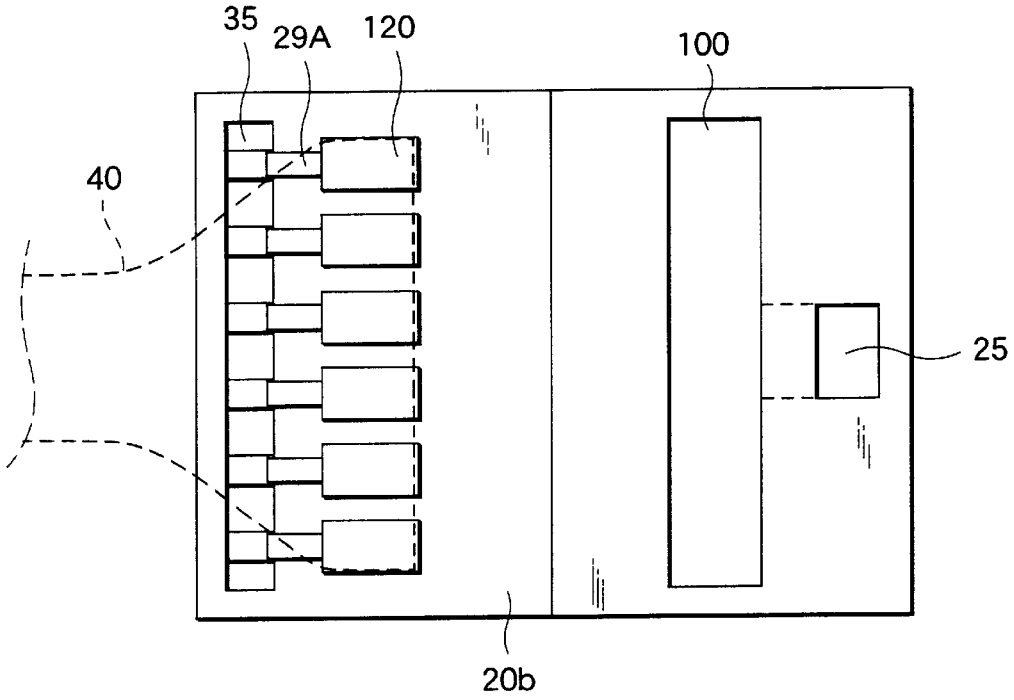
FIGS. 18A and 18B are a plan view and a sectional view to show a modified example of the ink jet recording head according to the eighth embodiment of the invention.
Figure 18B:
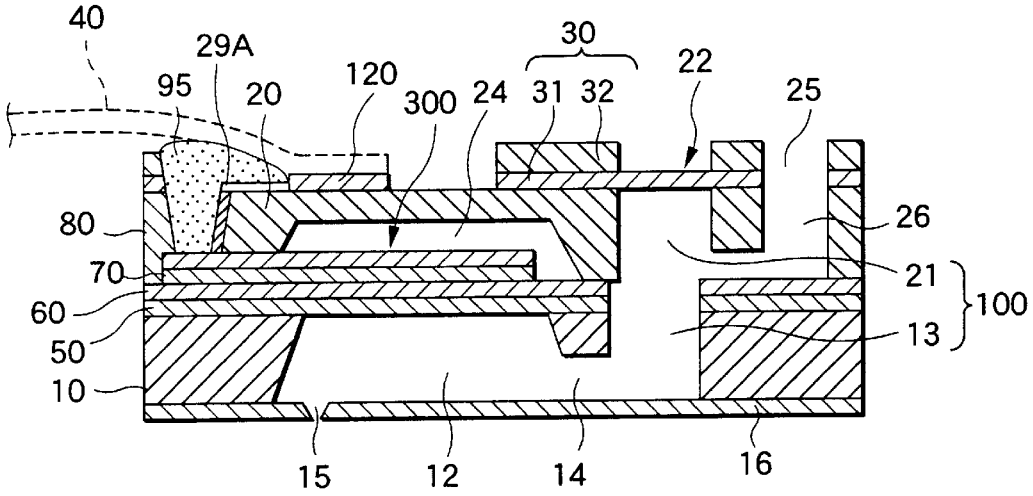

In the embodiment, the wiring 29 is extended by wire bonding from the upper electrode film 80, but the scope of the invention is not limited to it. For example, as shown in FIGS. 18A and 18B, a conductive thin film of gold (Au), etc., may be formed on the inner peripheral surface of the through groove 35 and on the top of the compliance substrate 30 and may be patterned for each piezoelectric element 300, thereby providing wiring 29A.

Figure 19A:
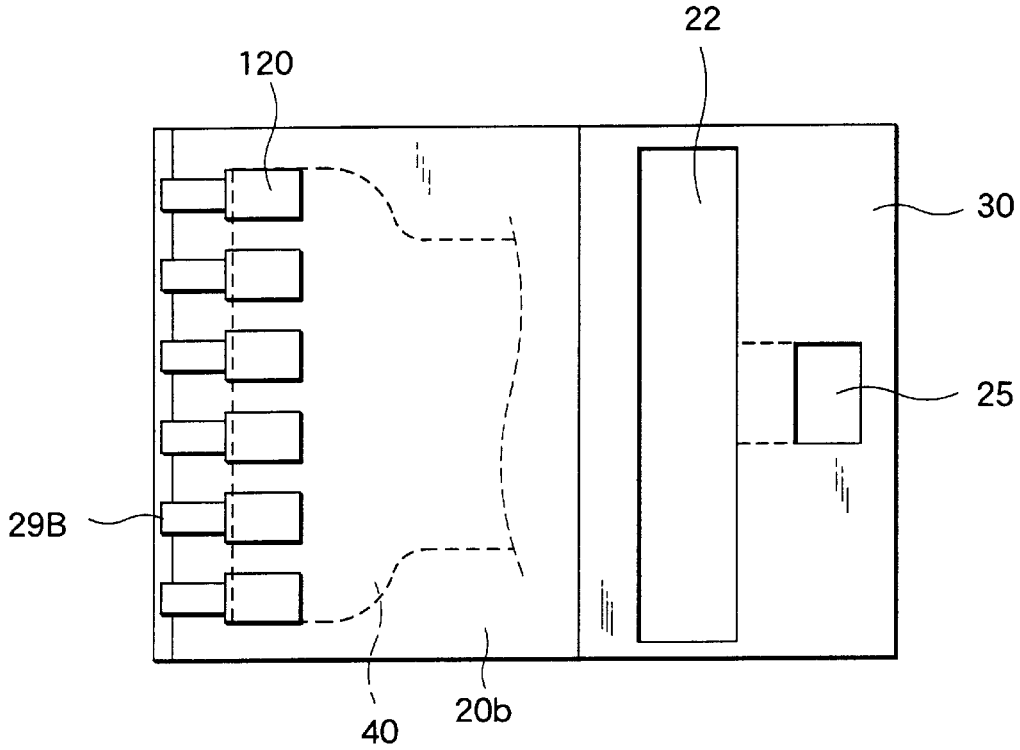
FIGS. 19A and 19B are a plan view and a sectional view to show a modified example of the ink jet recording head according to the eighth embodiment of the invention.
Figure 19B:
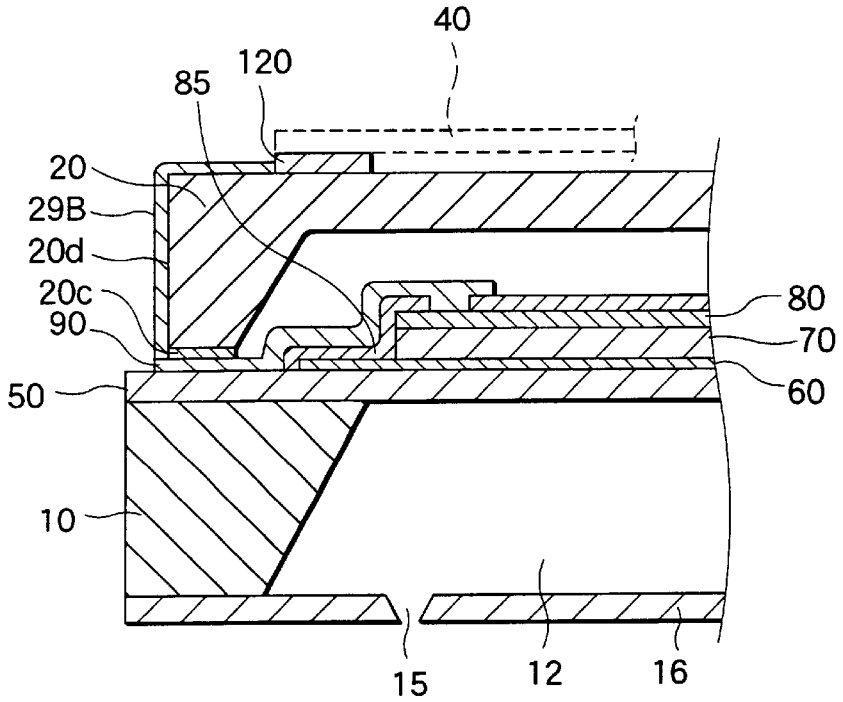

Further, for example, as shown in FIGS. 19A and 19B, wiring 29B may be extended via a joint face 20*c* and an outer face 20*d* of the reservoir forming substrate 20 to the exposed portion 20*b* of the piezoelectric element 300 and the end part of the wiring 29B may be made the installation section 120 for connecting to the external wiring 40. To provide the wiring 29B, preferably a lead electrode 90 is extended from the upper electrode film 80 to the joint face 20*c* of the reservoir forming substrate 20 and the upper electrode film 80 and the wiring 29B are joined via the lead electrode 90, as shown in the figures, whereby a gap with an elastic film 50 when the reservoir forming substrate 20 is bonded becomes only several $\mu$m and the piezoelectric elements 300 can be hermetically sealed in a piezoelectric element holding section 24 more reliably, as described above.

Figure 20A:
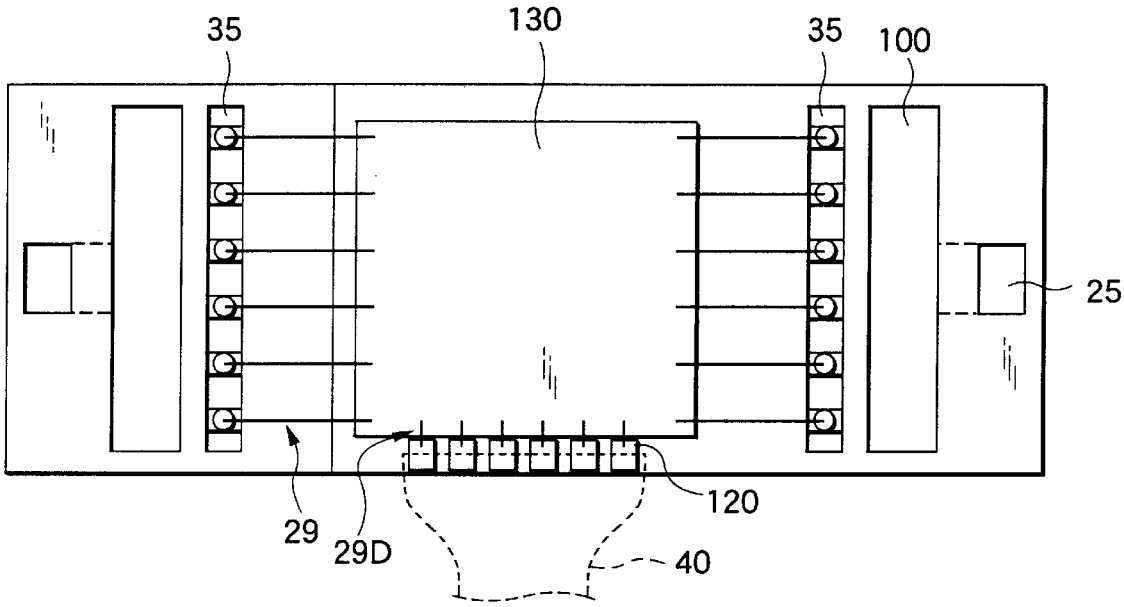
FIGS. 20A and 20B are a plan view and a sectional view of an ink jet recording head according to a ninth embodiment of the invention.
Figure 20B:
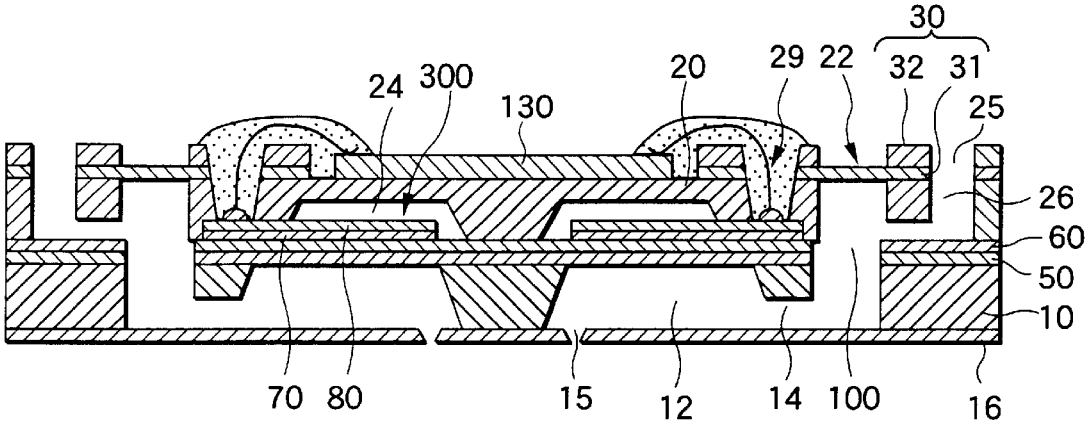

FIGS. 20A and 20B are a plan view and a sectional view of the main part of an ink jet recording head according to a ninth embodiment of the invention.

In the ninth embodiment, as shown in FIGS. 20A and 20B, a channel forming substrate 10 is formed with two rows of pressure generating chambers 12 placed side by side in the width direction thereof so that the end parts of the pressure generating chambers 12 on the side of nozzle orifices 15 in one row are opposed to those in the other, and a piezoelectric element 300 is formed in the area corresponding to each pressure generating chamber 12. A reservoir 100 is provided for each row of the pressure generating chambers 12 on the outside in the longitudinal direction of the pressure generating chambers 12 and an ink introduction port 25 and an ink introduction passage 26 are made to communicate with each reservoir 100. The structures of the reservoir, the ink introduction port, etc. are similar to those in the above-described embodiments.

Each piezoelectric element 300 is extended from the area facing the corresponding pressure generating chamber 12 to the top of the peripheral wall on the side of the reservoir 100 and is sandwiched between the channel forming substrate 10 and a reservoir forming substrate 20. As in the eighth embodiment, a through groove 35 is provided for each row of the pressure generating chambers 12 on the side of a reservoir section 21 of the reservoir forming substrate 20, namely, in the area facing an upper electrode film 80 of the piezoelectric element 300 in the area facing the peripheral wall of the pressure generating chamber 12. For example, a drive circuit 130 for driving the piezoelectric elements 300 is mounted on the reservoir forming substrate 20 in the area corresponding to the space between the rows of the pressure generating chambers 12. The drive circuit 130 may be a circuit board or a semiconductor integrated circuit (IC)

containing the drive circuit. The upper electrode film 80 of each piezoelectric element 300 and the drive circuit 130 are connected by wiring 29 extended by wire bonding, etc., through the through groove 35. Further, wiring 29D for supplying a signal to the drive circuit 130 is placed on the reservoir forming substrate 20 and is connected at one end to the drive circuit 130 and an opposite end of the wiring 29D forms an installation section 120 to which external wiring 40 is connected.

According to the composition, the head can also be miniaturized as in the eighth embodiment. Further, in the embodiment, the through groove 35 is made on the side of the reservoir 100, so that piezoelectric elements 300, the drive circuit 130, and the like can be connected more efficiently between the rows of the pressure generating chambers 12.

In the embodiment, the drive circuit 130 is placed on the reservoir forming substrate 20, but the scope of the invention is not limited to it. For example, the wiring extended from the piezoelectric element 300 and the external wiring such as a flexible cable may be connected on an exposed portion 10*a* of the reservoir forming substrate 20 as in the first embodiment, needless to say.

Figure 21:
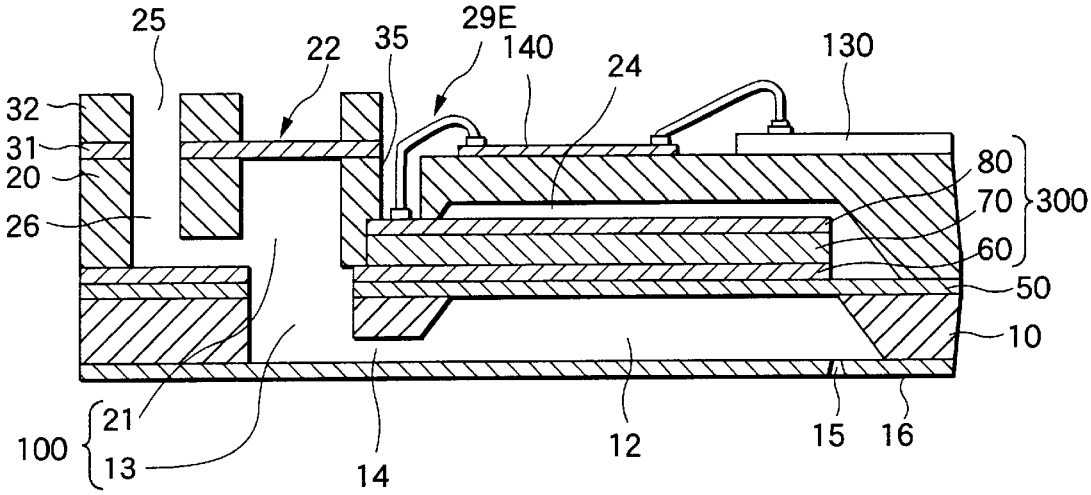
FIG. 21 is a sectional view to show a modified example of the ink jet recording head according to the ninth embodiment of the invention.
Figure 22:
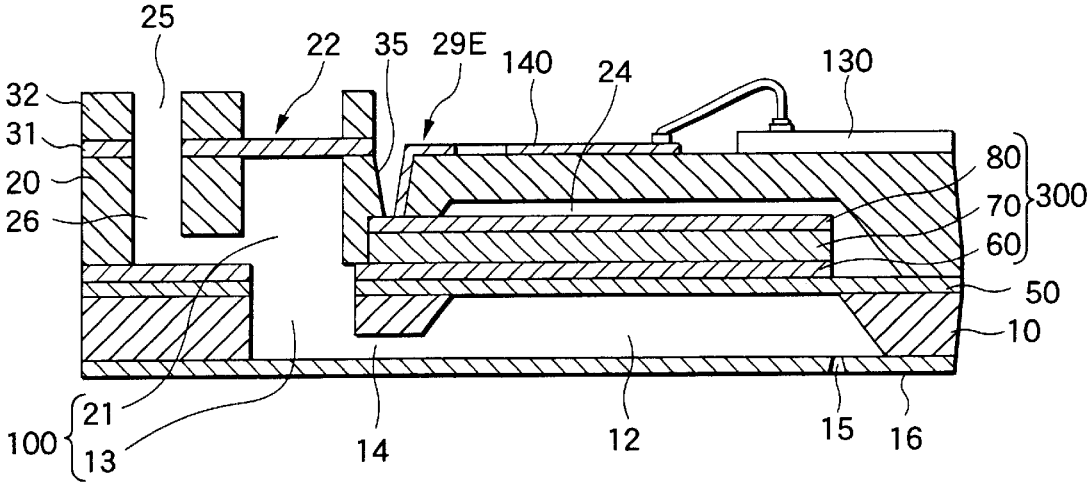
FIG. 22 is a sectional view to show a modified example of the ink jet recording head according to the ninth embodiment of the invention.

In the embodiment, the upper electrode films 80 of the piezoelectric elements 300 and the drive circuit 130 are connected by the wiring 29 extended only by wire bonding, but the scope of the invention is not limited to it. For example, as shown in FIG. 21, an IC wiring section 140 made of a thin film may be placed in the area between the drive circuit 130 on the reservoir forming substrate 20 and the through groove 35 and each piezoelectric element 300 and the drive circuit 130 may be connected via the IC wiring section 140. That is, wiring 29E may be extended by wire bonding from the upper electrode film 80 of each piezoelectric element 300 to one end part of the IC wiring section 140 and the drive circuit 130 may be connected by wire bonding to an opposite end part of the IC wiring section 140. The wiring 29E is extended by wire bonding from the upper electrode film 80 to the IC wiring section 140, but the scope of the invention is not limited to it. For example, as shown in FIG. 22, a conductive thin film of gold (Au), etc., may be formed on the inner peripheral surface of the through groove 35 and on the top of the reservoir forming substrate 20 and may be patterned for each piezoelectric element 300, thereby providing the wiring 29E.

Figure 23A:
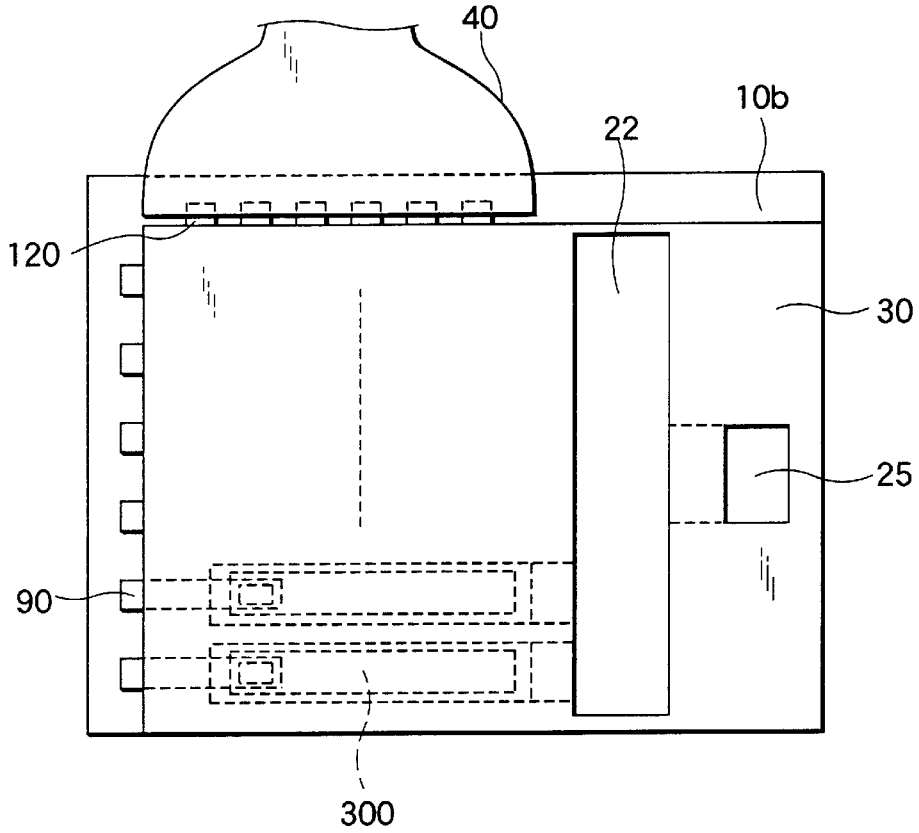
FIGS. 23A and 23B are a plan view and a sectional view of an ink jet recording head according to a tenth embodiment of the invention.
Figure 23B:
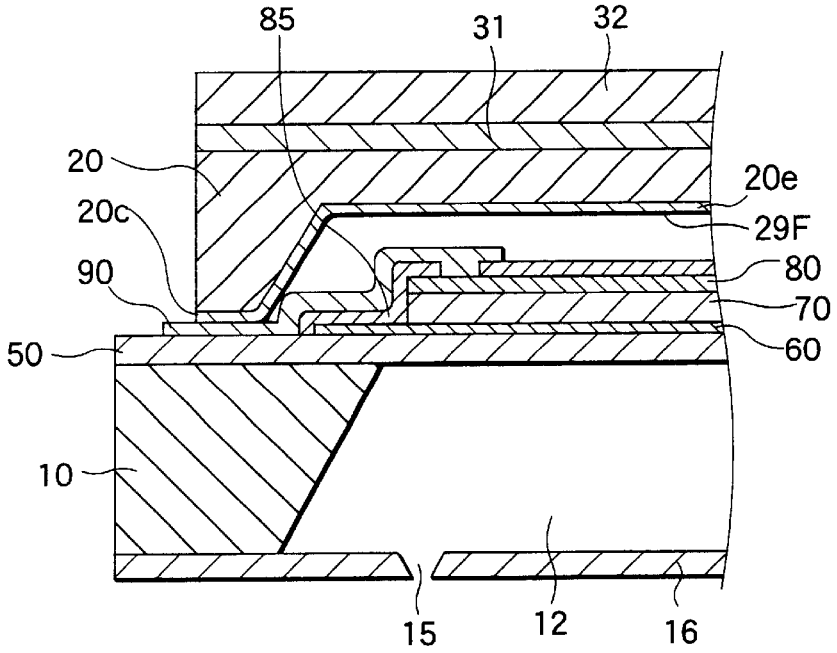

FIGS. 23A and 23B are a plan view and a sectional view of the main part of an ink jet recording head according to a tenth embodiment of the invention.

As shown in FIGS. 23A and 23B, the tenth embodiment is an example wherein an installation section 120 is placed in an exposed portion 10*b* on one end part side of a channel forming substrate 10 in the direction in which piezoelectric elements 300 are placed side by side.

That is, in the embodiment, each piezoelectric element 300 is placed in the area facing each pressure generating chamber 12 and a lead electrode 90 is extended from an upper electrode film 80 to the area facing a joint face 20*c* of a reservoir forming substrate 20. Wiring 29F is placed on the joint face 20*c* of the reservoir forming substrate 20 and an inner face 20*e* of a piezoelectric element holding section 24, and the lead electrode 90 and the installation section 120 are connected. The tenth embodiment is similar to the first embodiment in other points.

The route of the wiring 29F is not limited; when the reservoir forming substrate 20 is bonded with an adhesive, etc., the wiring 29F, the end part of each lead electrode 90, and one end of the installation section 120 may be connected.

In the composition, external wiring 40 can be drawn out from one end part in the width direction of the pressure generating chamber 12, so that it is made possible to arrange a plurality of recording heads horizontally. Of course, similar advantages to those of the above-described embodiments can be provided.

Figure 24A:
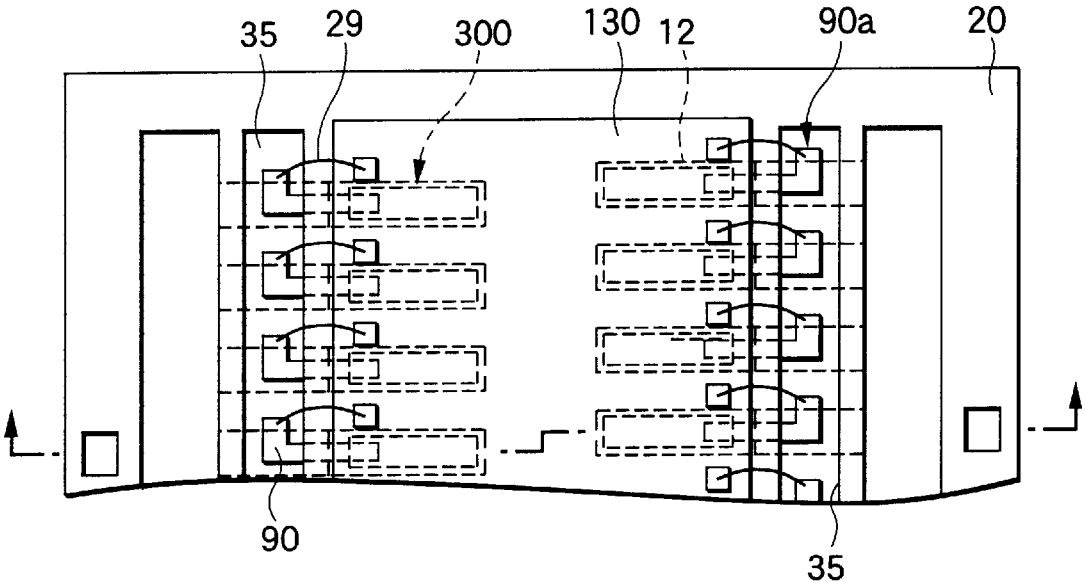
FIGS. 24A and 24B are a plan view and a sectional view of an ink jet recording head according to an eleventh embodiment of the invention.
Figure 24B:
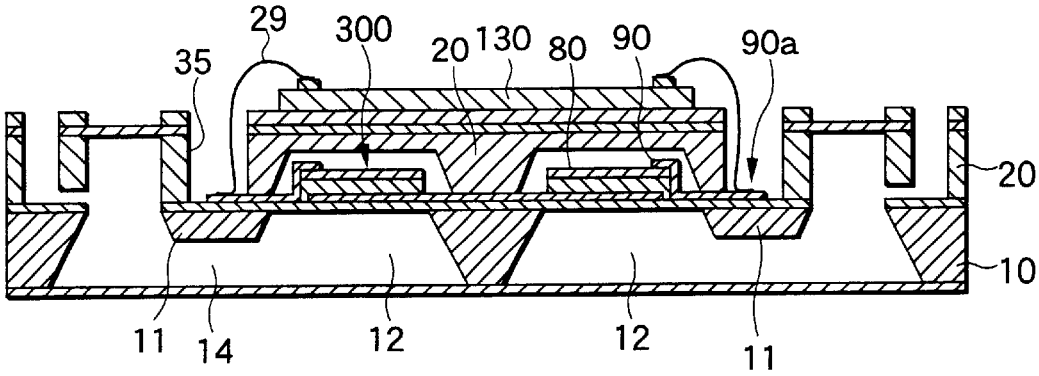

FIGS. 24A and 24B are a plan view and a sectional view of the main part of an ink jet recording head according to an eleventh embodiment of the invention.

In the embodiment, to drive a piezoelectric element 300, a drive circuit 130 is mounted on a reservoir forming substrate 20 and electrically connected with the piezoelectric element 300 via a wiring 29 extended by wire bonding. Therein the drive circuit 130 can be replaced a semiconductor integrated circuit including a drive circuit or a circuit substrate.

Hereinafter detailed description on wiring connecting method of the piezoelectric element 300 with the drive circuit 130 is disclosed.

As shown in FIG. 24A, a lead electrode 90 is extended from a periphery of a longitudinal end portion of an upper electrode film 80 to an area facing to a pressure generating chambers 12 and ink supply ports 14, for example in this embodiment, the extended lead electrode 90 is placed on the partition wall 11 dividing the ink supply ports 14.

As shown in FIG. 24B, a through groove 35 penetrated in the thickness direction of reservoir forming substrate 20 is provided across rows of the pressure generating chambers 12 and faces to an area where the ends of the lead electrodes 90 are situated. That is, one end of the wiring 29 is connected to the drive circuit 130 while the other end placed in this through groove 35 is connected to one of the end of the lead electrode 90. Therefore, a connecting point 90a connected by the wiring 29 to the lead electrode 90 extended from the piezoelectric element 300 is provided in an area facing to the partition wall 11.

Thus, providing the connecting point 90*a* between the wiring 29 and the lead electrode 90 extended from the piezoelectric element 300 in the area facing to the partition wall 11, it can be prevented from cracking on a channel forming substrate 10 due to load occurring when the wiring 29 is connected to the lead electrode 90. Therefore, an ink jet recording head with advanced reliability can be provided.

And as a further merit in the embodiment, since the connection point 90*a* is provided on the partition wall 11 in an area corresponding to the ink supply port 14, namely, the outside of the end portion in the longitudinal direction of the pressure generating chambers 12, the connecting point 90*a* is exposed outside at the through groove 35, and thereby it is easy to connect the wiring 29 to the lead electrode 90 at the connecting point 90*a*.

The embodiments of the invention have been described, but the basic composition of the ink jet recording head is not limited to the compositions described above.

For example, in the above-described embodiments, the reservoir forming substrate 20 having the reservoir section 21 forming a part of the reservoir 100 as the reservoir forming member is joined to one side of the channel forming substrate 10, but the scope of the invention is not limited to it. For example, the reservoir forming member may adopt a structure wherein a plurality of substrates are used to form the reservoir.

Likewise, the nozzle plate 16 is joined as the reservoir forming member, but the scope of the invention is not limited to it. For example, a multi-layer structure containing another substrate having nozzle communication holes, etc., to allow nozzle orifices and pressure generating chambers to communicate with each other may be adopted.

In the above-described embodiments, ink jet recording heads of thin film type that can be manufactured by applying the film formation and lithography process are taken as examples, but the scope of the invention is not limited to them. For example, the invention can also be adopted for ink jet recording heads of thick film type formed by a method of putting a green sheet or the like.

Figure 25:
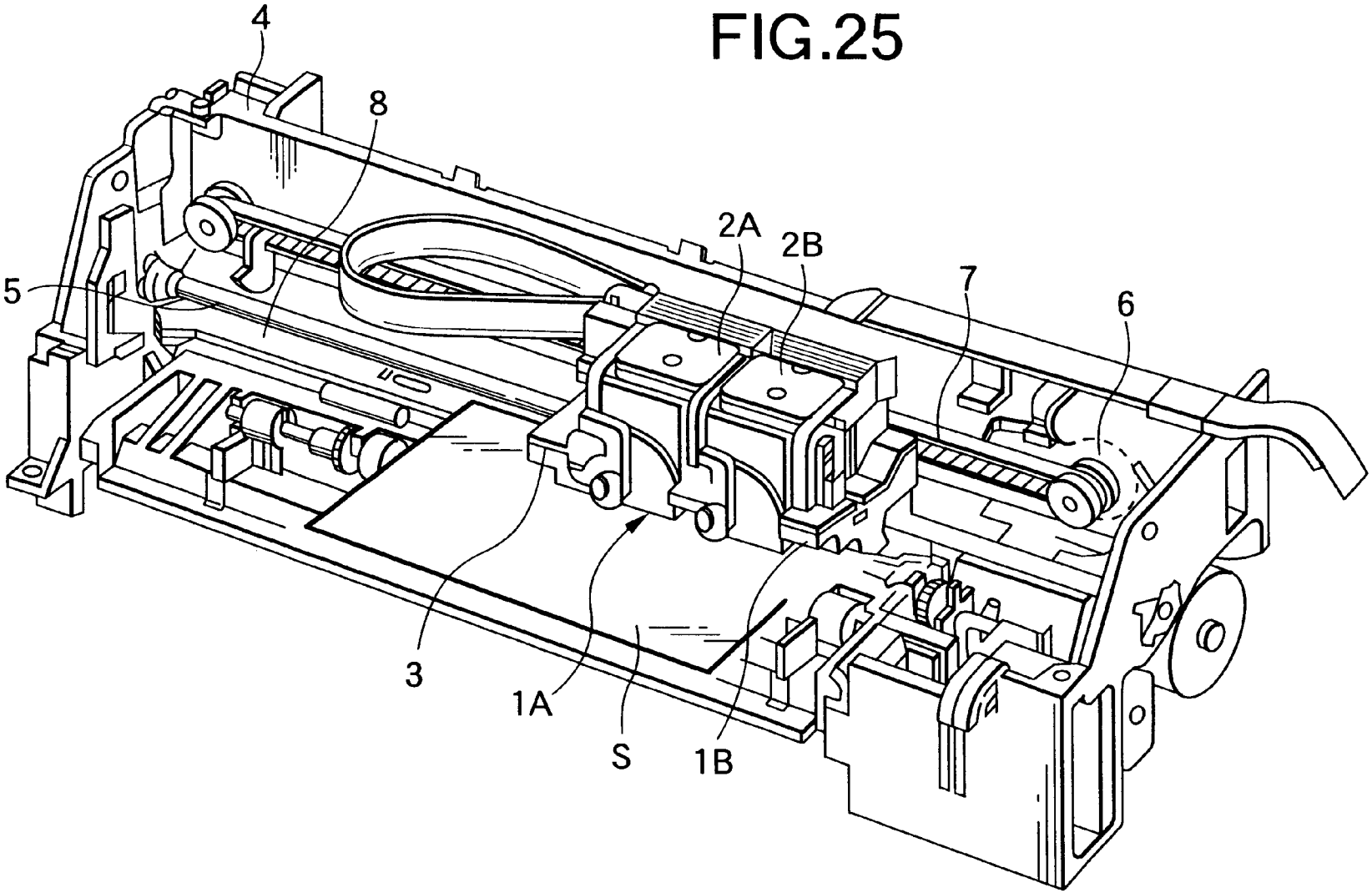
FIG. 25 is a schematic diagram of an ink jet recording apparatus according to one embodiment of the invention.

Each of the ink jet recording heads of the embodiments forms a part of a recording head unit comprising an ink flow passage communicating with an ink cartridge, etc., and is installed in an ink jet recording apparatus. FIG. 25 is a schematic diagram to show an example of the ink jet recording apparatus.

As shown in FIG. 25, cartridges 2A and 2B constituting an ink supply member are detachably placed in recording head units 1A and 1B each having an ink jet recording head, and a carriage 3 on which the recording head units 1A and 1B are mounted is placed axially movably on a carriage shaft 5 attached to a recorder main body 4. The recording head units 1A and 1B jet a black ink composite and a color ink composite respectively, for example.

The driving force of a drive motor 6 is transmitted to the carriage 3 via a plurality of gears (not shown) and a timing belt (not shown), whereby the carriage 3 on which the recording head units 1A and 1B are mounted is moved along the carriage shaft 5. On the other hand, the recorder main body 4 is provided with a platen 8 along the carriage shaft 5. A recording sheet S of a recording medium such as paper fed by a paper feed roller, etc., (not shown) is wrapped around the platen 8 and is transported.

As described above, according to the invention, the reservoir forming substrate forming at least a part of the reservoir is joined onto the channel forming substrate for forming the reservoir, thus the structure of the head can be simplified; the manufacturing process can be decreased and the manufacturing costs can be reduced. Since the reservoir forming substrate also serves as the capping member for insulating the piezoelectric elements from the outside, the piezoelectric elements can be prevented from being destroyed due to the external environment, and the durability can be improved. Further, the piezoelectric elements and the external wiring are connected on the reservoir forming substrate, whereby the head can be miniaturized.

What is claimed is:

1. An ink jet recording head comprising:

a nozzle forming member provided with a plurality of nozzle orifices for jetting ink;

a channel forming substrate provided with a plurality of pressure generating chambers communicated with the associated nozzle orifices, one face of which is bonded to the nozzle forming member;

a plurality of piezoelectric elements provided on an face of the channel forming substrate which is opposed to the face bonded to the nozzle forming substrate with a vibration plate in between for changing the associated pressure generating chambers in volume thereof; and a reservoir forming member bonded to the face of the channel forming substrate on which the piezoelectric elements are provided, the reservoir forming member having a reservoir section forming at least a part of a reservoir communicated with the pressure generating chambers for supplying ink thereto, and a piezoelectric element holding section for defining a space in an area facing the piezoelectric elements such an extent that motion of the respective piezoelectric elements is exhibited while sealing the space hermetically.

2. The ink jet recording head as set forth in claim 1, wherein the piezoelectric element holding section is partitioned by partition walls so as to correspond to the respective piezoelectric elements and the partition walls are bonded to the channel forming substrate.

3. The ink jet recording head as set forth in claim 1, wherein the channel forming substrate is formed with a communication section for communicating with the reservoir section of the reservoir forming member to form a part of the reservoir together with the reservoir section.

4. The ink jet recording head as set forth in claim 3, wherein cross-sectional shapes of the reservoir section and the communication section are identical in directions perpendicular to a laminating direction of the reservoir forming member and the channel forming substrate.

5. The ink jet recording head as set forth in claim 1, wherein the reservoir and each pressure generating chamber are made to communicate with each other via an ink supply passage relatively narrower than the reservoir.

6. The ink jet recording head as set forth in claim 1, wherein an ink introduction port communicating with the outside for supplying ink to the reservoir is made to communicate with the reservoir section.

7. The ink jet recording head as set forth in claim 1, wherein the reservoir section is so formed as to be across the pressure generating chambers placed side by side.

8. The ink jet recording head as set forth in claim 1, wherein a part of the reservoir section has a flexible section having flexibility.

9. The ink jet recording head as set forth in claim 8, wherein the channel forming substrate in the area corresponding to the reservoir section is formed with a through section piercing the channel forming substrate without communicating with the pressure generating chambers, and wherein the flexible portion is defined as a section between the through section and the reservoir section.

10. The ink jet recording head as set forth in claim 9, wherein the through section is so formed as to be across the pressure generating chambers placed side by side.

11. The ink jet recording head as set forth in claim 9, wherein the through section is etched together with the pressure generating chambers and is formed.

12. The ink jet recording head as set forth in claim 8, wherein the flexible section is provided by bonding a flexible member.

13. The ink jet recording head as set forth in claim 12, wherein the flexible member is a thin film made of at least one of metal and ceramic.

14. The ink jet recording head as set forth in claim 12, wherein the flexible member is made of a resin material.

15. The ink jet recording head as set forth in claim 14, wherein the resin material is at least one selected from the group consisting of fluororesin, silicone resin, and silicone rubber.

16. The ink jet recording head as set forth in claim 12, wherein the flexible member contains a layer having a tensile stress.

17. The ink jet recording head as set forth in claim 12, wherein the flexible member is composed of a layer forming the piezoelectric elements.

18. The ink jet recording head as set forth in claim 12, wherein another substrate having a through hole at least in an area facing the flexible section is bonded to the flexible member.

19. The ink jet recording head as set forth in claim 12, wherein a projected beam member is provided on the surface of the flexible member on the opposite side to the reservoir section so as to extend in a plane direction of the flexible member.

20. The ink jet recording head as set forth in claim 19, wherein the beam member is formed like a grid.

21. The ink jet recording head as set forth in claim 12, wherein the reservoir section is provided with at least one beam-like reinforcing member across side walls defining the reservoir section and facing each other.

22. The ink jet recording head as set forth in claim 21, wherein at least a part of the reinforcing member is thinner than any other portion of the reservoir forming member.

23. The ink jet recording head as set forth in claim 22, wherein at least a part of the reinforcing member on the side of the channel forming substrate is removed and is thinner than any other portion.

24. The ink jet recording head as set forth in claim 21, wherein the reinforcing member is formed along the longitudinal direction of the piezoelectric elements.

25. The ink jet recording head as set forth in claim 1, wherein at least a part of the area of the reservoir forming member facing the piezoelectric element is formed with a detection through hole for detecting displacement of the piezoelectric element.

26. The ink jet recording head as set forth in claim 25, wherein the piezoelectric element holding section is formed by piercing the reservoir forming member and is sealed with a transparent member, and also serves as the detection through hole.

27. The ink jet recording head as set forth in claim 26, wherein the transparent member forms the flexible section.

28. The ink jet recording head as set forth in claim 1, further comprising:

a first wiring drawn out from the piezoelectric element on the channel forming substrate;

a second wiring provided on the reservoir forming member in an area opposite side of the channel forming substrate;

a connection wiring for connecting the first and second wirings; and an external wiring connected to the second wiring.

29. The ink jet recording head as set forth in claim 28, wherein the connection wiring is formed by wire bonding.

30. The ink jet recording head as set forth in claim 28, wherein the connection wiring is formed of a thin film.

31. The ink jet recording head as set forth in claim 28, wherein the reservoir forming member is formed with a communication hole piercing the reservoir forming member for communicating with the outside in the area corresponding to the piezoelectric element, and wherein the connection wiring is provided via the communication hole.

32. The ink jet recording head as set forth in claim 31, wherein the communication hole is provided in an area facing a peripheral wall of the pressure generating chamber on the reservoir side.

33. The ink jet recording head as set forth in claim 31, wherein the communication hole is provided in an area facing a peripheral wall of the pressure generating chamber on the nozzle orifice side.

34. The ink jet recording head as set forth in claim 28, wherein a drive circuit for driving the piezoelectric elements is mounted in the reservoir forming member, and wherein the connection wiring is connected to the drive circuit.

35. The ink jet recording head as set forth in claim 34, wherein the drive circuit is a semiconductor integrated circuit.

36. The ink jet recording head as set forth in claim 1, wherein the reservoir forming member is a reservoir forming substrate including the reservoir section.

37. The ink jet recording head as set forth in claim 36, wherein the thermal expansion coefficient of the reservoir forming substrate is substantially the same as that of the channel forming substrate.

38. The ink jet recording head as set forth in claim 36, wherein the reservoir forming substrate is made of at least one material selected from the group consisting of silicon, glass, and ceramics.

39. The ink jet recording head as set forth in claim 1, wherein the nozzle forming member is formed of substantially the same material as the channel forming substrate and the reservoir forming member.

40. The ink jet recording head as set forth in claim 1, wherein the nozzle forming member is a nozzle plate provided with the nozzle orifices.

41. The ink jet recording head as set forth in claim 1, wherein the pressure generating chambers are formed on a ceramic substrate, and wherein the layers of the piezoelectric element are formed by either putting a green sheet or printing.

42. The ink jet recording head as set forth in claim 1, wherein the pressure generating chambers are formed on a silicon monocrystalline substrate by anisotropic etching, and wherein the layers of the piezoelectric element are formed by thin film deposition and lithography method.

43. The ink jet recording apparatus as set forth in claim 1, wherein the respective pressure generating chambers are divided by partition walls;

wherein a driving semiconductor for driving an associated piezoelectric element is provided on the reservoir forming member; and wherein the driving semiconductor and the associated piezoelectric element are connected by wiring at an area facing to the partition wall.

44. An ink jet recording apparatus comprising an ink jet recording head as set forth in any of claims 1 to 43.

45. An ink jet recording head comprising:

a nozzle forming member provided with a plurality of nozzle orifices for jetting ink;

a channel forming substrate provided with a plurality of pressure generating chambers communicated with the associated nozzle orifices, one face of which is bonded to the nozzle forming member;

a plurality of piezoelectric elements provided on an face of the channel forming substrate which is opposed to the face bonded to the nozzle forming member with a vibration plate in between for changing the associated pressure generating chambers in volume thereof; and a sealing member bonded to the face of the channel forming substrate on which the piezoelectric elements are provided, the sealing member having walls for defining a space in an area facing the piezoelectric elements such an extent that motion of the respective piezoelectric elements is exhibited while sealing the space hermetically, wherein one of the walls of the sealing member is disposed on each of the piezoelectric elements.

46. The ink jet recording head as set forth in claim 45, wherein:

each of the piezoelectric elements includes an active part deformed to change the volume of an associated pressure generating chamber and an inactive part not to be deformed; and one of the walls of the sealing member is disposed on the inactive part of each piezoelectric element.

47. The ink jet recording head as set forth in claim 46, wherein one end of the inactive part of each piezoelectric element is extended to the outside of the sealing member.

48. The ink jet recording head as set forth in claim 47, wherein a lead electrode is electrically connected to the inactive part of each piezoelectric element which is situated outside the sealing member.

49. The ink jet recording head as set forth in claim 45, wherein the sealing member is formed with a reservoir section forming at least a part of a reservoir which stores ink supplied to the pressure generating chambers.

50. The ink jet recording head as set forth in claim 45, wherein the sealing member is comprised of a silicon monocrystalline substrate.

51. The ink jet recording head as set forth in claim 45, wherein:

the pressure generating chambers are formed in a silicon monocrystalline substrate by anisotropic etching; and the piezoelectric elements are formed by thin film deposition and lithography method.

52. An ink jet recording apparatus comprising an ink jet recording head as set forth in any of claims 45 to 51.

* * * * *